US006604844B2

(12) United States Patent
Hussey

(10) Patent No.: US 6,604,844 B2
(45) Date of Patent: Aug. 12, 2003

(54) RECONFIGURABLE REFLECTIVE APPARATUS

(76) Inventor: Richard Hussey, 41 Ehrbar Ave., Apt. 1B, Mount Vernon, NY (US) 10552

( * ) Notice: Subject to any disclaimer, the term of this patent is extended or adjusted under 35 U.S.C. 154(b) by 0 days.

(21) Appl. No.: 09/682,500

(22) Filed: Sep. 10, 2001

(65) Prior Publication Data

US 2002/0023673 A1 Feb. 28, 2002

Related U.S. Application Data

(63) Continuation-in-part of application No. 09/337,218, filed on Jun. 20, 1999, now Pat. No. 6,286,530.

(51) Int. Cl.[7] ..... F21V 7/18; F21V 1/06

(52) U.S. Cl. ..... 362/341; 362/18; 362/282; 362/352; 362/449; 135/147; 135/98; 135/33.41; 403/53; 403/84; 403/170

(58) Field of Search ..... 135/135, 159, 135/28, 33.2, 33.41, 33.5, 98, 99, 20, 3, 147; 403/170, 53, 83, 84; 52/646; 362/18, 282, 283, 296, 319, 341, 352, 449, 450

(56) References Cited

U.S. PATENT DOCUMENTS

| | | | | |
|---|---|---|---|---|
| 131,696 | A | * | 9/1872 | Mathewson |
| 554,792 | A | | 2/1896 | Pittenger et al. |
| 572,843 | A | * | 12/1896 | Van Vechten |
| 706,605 | A | * | 8/1902 | Slyder |
| 923,542 | A | | 6/1909 | Losey |
| 2,465,140 | A | * | 3/1949 | Vila |
| 2,587,511 | A | | 2/1952 | Nerman |
| 2,743,734 | A | | 5/1956 | Terrell et al. |
| 3,252,469 | A | | 5/1966 | Peake |
| 3,294,962 | A | | 12/1966 | Hilzen |
| 3,429,320 | A | | 2/1969 | Edelkind |
| 3,781,535 | A | | 12/1973 | Larson |

(List continued on next page.)

FOREIGN PATENT DOCUMENTS

| | | | | |
|---|---|---|---|---|
| FR | 1165212 | | 10/1958 | |
| FR | 1436059 | | 12/1966 | |
| IT | 599441 | * | 11/1959 | ..... 135/98 |
| IT | 606032 | * | 6/1960 | ..... 135/98 |

*Primary Examiner*—Robert Canfield
(74) *Attorney, Agent, or Firm*—George M. Macdonald

(57) ABSTRACT

A reconfigurable reflective apparatus that includes a flexible reflector supported by a plurality of support ribs that are pivotally connected to a central locking control hub, wherein at least one support rib can be independently set in any one of a plurality of pivot positions.

21 Claims, 20 Drawing Sheets

U.S. PATENT DOCUMENTS 3,783,573 A * 1/1974 Vaughan
3,851,164 A 11/1974 Intrator
4,030,103 A * 6/1977 Campbell
4,317,552 A 3/1982 Weidler
4,460,946 A 7/1984 Tinz
4,524,405 A 6/1985 Heard
4,578,920 A * 4/1986 Bush et al.
4,608,571 A * 8/1986 Luly
4,627,210 A * 12/1986 Beaulieu
4,642,652 A * 2/1987 Herbig et al.
4,836,231 A * 6/1989 Peterson
4,836,232 A * 6/1989 DeRosa et al.
4,966,178 A 10/1990 Eichhorn
4,995,212 A * 2/1991 Morgan et al.
5,046,699 A 9/1991 Perreault et al.
5,148,648 A * 9/1992 Sorenson et al.
5,152,495 A 10/1992 Jacinto et al.
5,156,369 A 10/1992 Tizzoni
5,249,591 A 10/1993 Gamadi
5,697,111 A 12/1997 Dillner
5,738,129 A * 4/1998 Vogt
5,797,695 A * 8/1998 Prusmack
5,816,276 A 10/1998 Seidel et al.
5,819,342 A 10/1998 Williams
5,845,665 A 12/1998 Koehn
5,927,310 A 7/1999 Lin
5,954,415 A 9/1999 Weigert
6,086,284 A 7/2000 Callahan
6,116,256 A * 9/2000 Pawsey et al.
6,286,530 B1 * 9/2001 Hussey
6,296,415 B1 10/2001 Johnson et al.
2002/0059770 A1 * 5/2002 Fritsche et al.

* cited by examiner

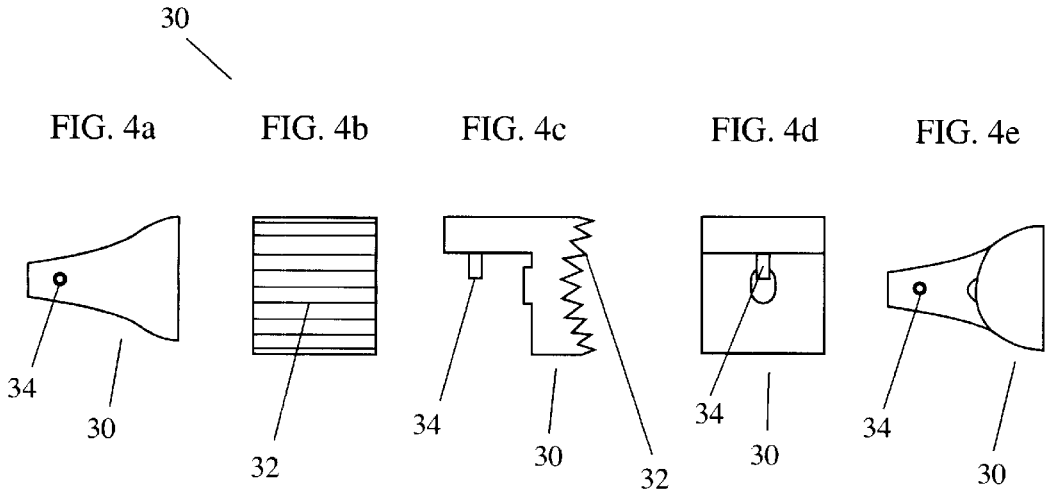
30
FIG. 4a
FIG. 4b
FIG. 4c
FIG. 4d
FIG. 4e
34
30
32
34
30
32
34
30
34
30
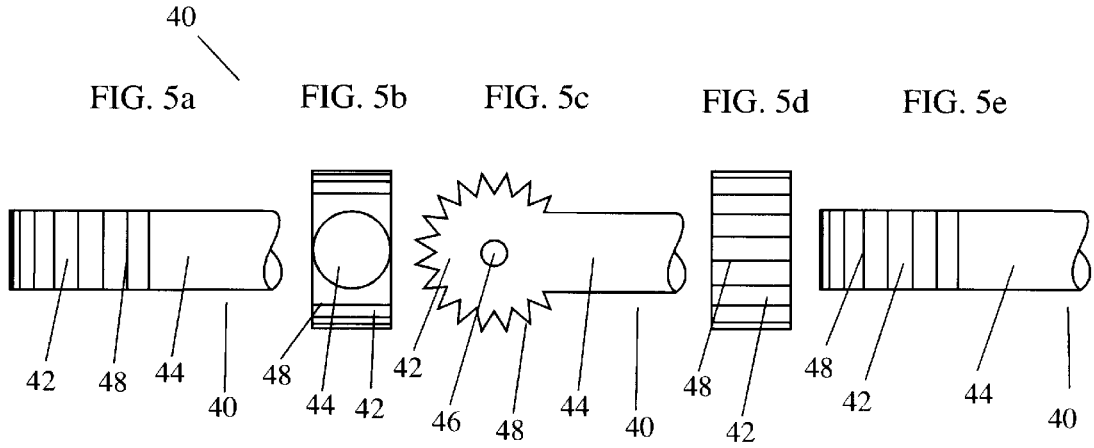
40
FIG. 5a
FIG. 5b
FIG. 5c
FIG. 5d
FIG. 5e
42
48
44
40
48
44
42
42
46
48
44
40
48
42
48
42
44
40
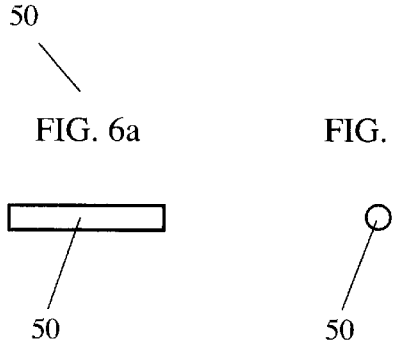
50
FIG. 6a
FIG. 6b
50
50

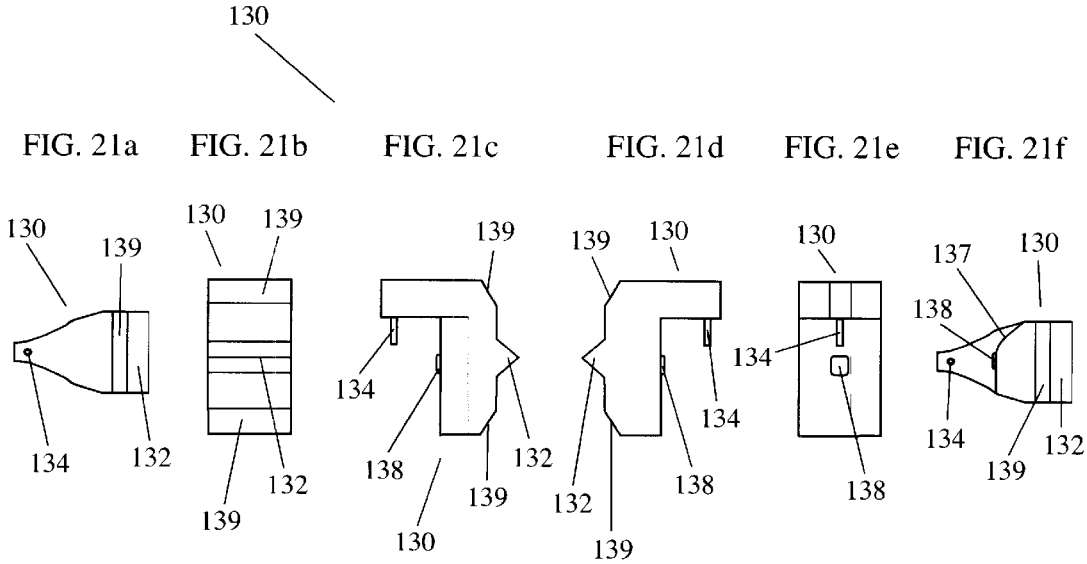
130
FIG. 21a
FIG. 21b
FIG. 21c
FIG. 21d
FIG. 21e
FIG. 21f
130
139
134
132
130
139
132
139
139
134
138
132
139
130
139
130
134
132
138
139
130
134
138
137
138
134
139
132
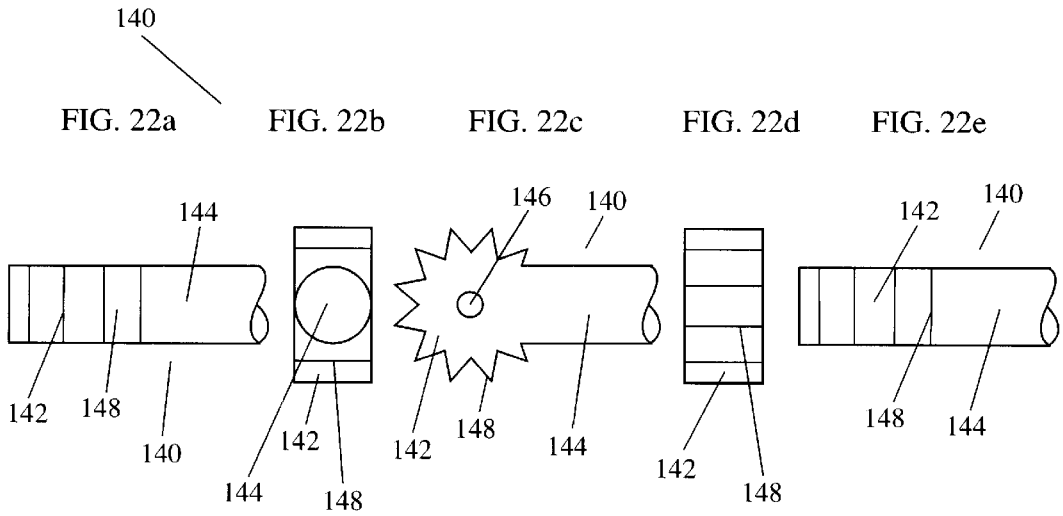
140
FIG. 22a
FIG. 22b
FIG. 22c
FIG. 22d
FIG. 22e
144
142
148
140
142
144
148
146
140
142
148
144
142
148
142
140
148
144

RECONFIGURABLE REFLECTIVE APPARATUS

CROSS REFERENCE TO RELATED APPLICATIONS

The present application is a continuation-in-part of U.S. patent application Ser. No. 09/337,218, filed Jun. 20, 1999, now U.S. Pat. No. 6,286,530, which is incorporated herein in its entirety by reference.

BACKGROUND OF INVENTION

1. Field of the Invention

The present application relates generally to reconfigurable apparatus, and more particularly to a reconfigurable reflective apparatus having a central hub for setting and resetting a plurality of configurations.

2. Description of Related Art

Traditional shade umbrellas have several disadvantages in that they are often heavy, hard to handle, require a specific mounting, and do not always provide a high degree of protection from the sun. While traditional shade umbrellas are usually easily mounted in sand or soft earth, they have the disadvantage in that they are not easily mounted on a hard surface. Traditional shade umbrellas can be deployed either in only the fully open vertical position, or in some cases, the canopy may be tilted with respect to the vertical base. A further disadvantage of traditional shade umbrellas is that they do not perform well in high wind conditions.

Traditional shade umbrellas can be aesthetically pleasing and are often used in home gardens and for covering patio furniture. Traditional patio umbrella shade structures are often used as semi-permanent structures. The cloth or fabric that covers the frame of the semi-permanent shade structure deteriorates from the effects of rain, wind and sun. Accordingly, such structures are capable of being folded to minimize exposure to the elements. The folding mechanisms are often cumbersome and difficult to operate.

A further disadvantage of traditional shade umbrellas is a centrally located support shaft. This centrally located support shaft reduces the available usable area covered by the umbrella. Accordingly, towels or picnic blankets and the like must be arranged to avoid the central support shaft. Furthermore the shaded area shifts between sunrise and sunset, and articles protected beneath the umbrella must be shifted if continuous shade is required. A further disadvantage of traditional shade umbrellas is that they do not provide protection from wind.

A disadvantage of tents and canopies is that they are not easily reconfigurable for use in varied situations.

Traditional reflective umbrellas are utilized in studio photography, motion picture and video lighting and by traditional paint, ink and sketch artists to light scenes.

As can be appreciated, a traditional light umbrella with a seven foot diameter would have relatively large depth and might not be transportable by one person. Additionally, the traditional light umbrella might project shadows or ghost images created by the exposed ribs of traditional light umbrellas. Such traditional umbrellas might not be able to be placed flush enough with a ground surface for reflecting light up to a scene.

SUMMARY OF INVENTION

The present application describes embodiments of a reconfigurable apparatus. The apparatus is reconfigurable in that it may be set in one configuration and may be later reset into another configuration. In one embodiment, a reconfigurable sun shade and shelter apparatus having a flexible cover includes a central hub and a plurality of support ribs pivotally connected to the central hub, wherein at least one of the support ribs can be independently set into any one of a plurality of pivot positions.

In another embodiment, a reconfigurable reflective apparatus includes a central hub, a plurality of support ribs pivotally connected to the central hub and a reflector supported by the support ribs, wherein at least one of the support ribs can be independently set into any one of a plurality of pivot positions.

BRIEF DESCRIPTION OF DRAWINGS

FIG. 4*a* is a top view of a locking piston according to an embodiment of the present application;

FIG. 4*b* is a front view of a locking piston according to an embodiment of the present application;

FIG. 4*c* is a side view of a locking piston according to an embodiment of the present application;

FIG. 4*d* is a rear view of a locking piston according to an embodiment of the present application;

FIG. 4*e* is a bottom view of a locking piston according to an embodiment of the present application;

FIG. 5*a* is a top view of a pivot mount according to an embodiment of the present application;

FIG. 5*b* is a front view of a pivot mount according to an embodiment of the present application;

FIG. 5*c* is a side view of a pivot mount according to an embodiment of the present application;

FIG. 5*d* is a rear view of a pivot mount according to an embodiment of the present application;

FIG. 5*e* is a bottom view of a pivot mount according to an embodiment of the present application;

FIG. 6*a* is a top view of a pivot pin according to an embodiment of the present application;

FIG. 6*b* is a side view of a pivot pin according to an embodiment of the present application;

FIG. 21*a* is a top view of a locking piston according to an embodiment of the present application;

FIG. 21*b* is a front view of a locking piston according to an embodiment of the present application;

FIG. 21*c* is a side view of a locking piston according to an embodiment of the present application;

FIG. 21*d* is a side view of a locking piston according to an embodiment of the present application;

FIG. 21*e* is a rear view of a locking piston according to an embodiment of the present application;

FIG. 21*f* is a bottom view of a locking piston according to an embodiment of the present application;

FIG. 22*a* is a top view of a pivot mount according to an embodiment of the present application;

FIG. 22*b* is a front view of a pivot mount according to an embodiment of the present application;

FIG. 22*c* is a side view of a pivot mount according to an embodiment of the present application;

FIG. 22*d* is a rear view of a pivot mount according to an embodiment of the present application;

FIG. 22*e* is a bottom view of a pivot mount according to an embodiment of the present application;

DETAILED DESCRIPTION

Figure 1:
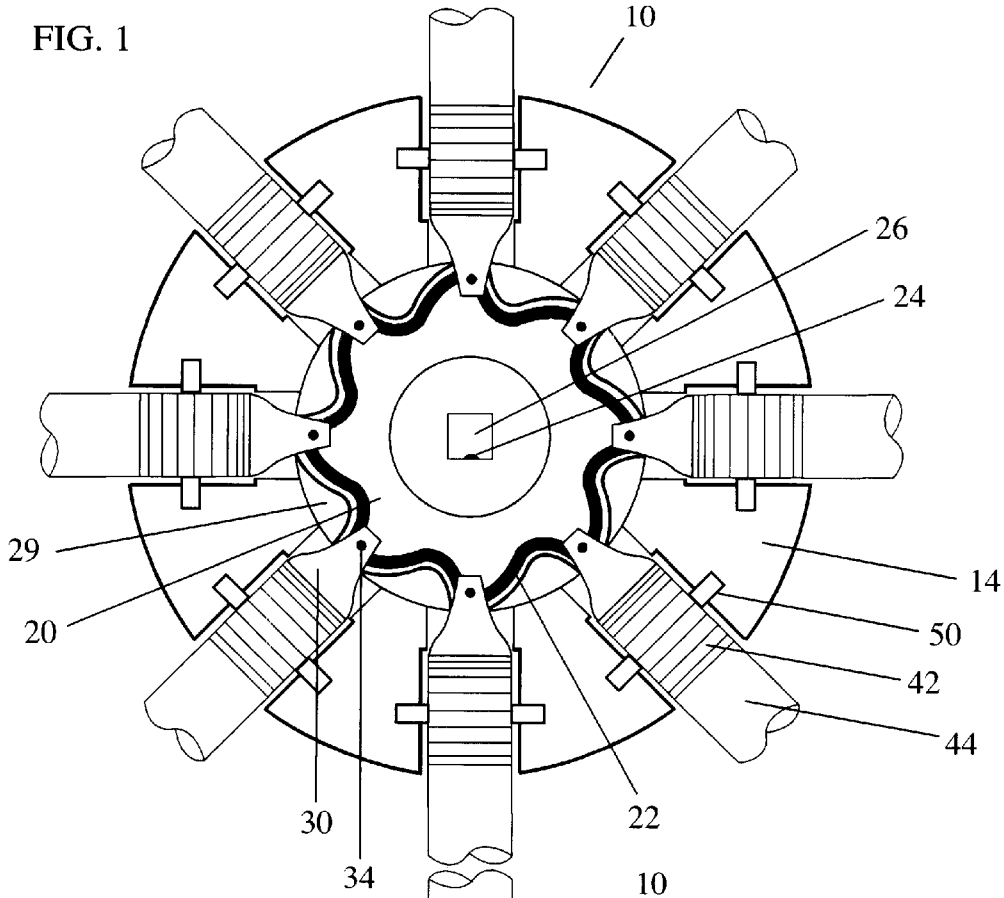
FIG. 1 is a top view with cut away of a central locking control hub in locked position of a reconfigurable sun shade and shelter apparatus according to an embodiment of the present application.

This application relates to a reconfigurable apparatus. In several embodiments, a reconfigurable sun shade and shelter apparatus is described and in several others, a reconfigurable reflective apparatus is described.

Detailed embodiments are described below. In one embodiment, a reconfigurable sun shade and shelter apparatus may be configured to provide shade from the sun and protection from wind and rain. The embodiments of the present application may provide a reconfigurable sun shade and shelter which will be reliable and effective in use. The square shape of the embodiment and the central locking control hub allow the sun shade and shelter to be reconfigured into many useful shapes. In one embodiment, the reconfigurable sun shade and shelter apparatus includes a central locking control hub and a plurality of support ribs that support a flexible shade cover.

As can be appreciated, many different configurations are possible and where alternatives are discussed, such are to be understood as alternative embodiments. For example, if alternatives for only one element are discussed, it is to be understood that such describes an alternative embodiment having the common characteristics with the alternative for the one element indicated. For example, in one embodiment, the reconfigurable sun shade and shelter apparatus includes a plurality of central locking control hubs, but the common elements are not described in detail. The central locking control hub allows the plurality of support ribs to be independently displaced at various angles in a vertical direction from one another in relation to the horizontal plane of the central locking control hub.

As will be appreciated, in one embodiment the plurality of support ribs of the reconfigurable sun shade and shelter apparatus support the flexible shade cover. The support ribs may be locked into many configurations in which any of the ribs are displaced at different angles from the central locking control hub. As described herein, the sun shade and shelter apparatus can be reconfigured into many shapes for use in different situations. The central locking control hub may be locked by a cam being moved into a locked position which pushes a locking piston along a cylinder in the housing of the central locking control hub thereby engaging a pivot mount attached to the hub. Each pivot mount is attached to a corresponding support rib that can be independently rotated vertically before the hub is locked.

The various parts of the central locking control hub can be constructed of plastic, metal alloy, fiberglass or other suitable material. The housing preferably comprises plastic parts including two housing halves to create a housing with an opening for a cam and 8 cylinder openings. The housing halves when combined create an opening for the cam to freely rotate when the key is turned. The housing halves comprise pivot pin channels for mounting the pivot pins. The housing halves may be fastened by glue or preferably the parts are fastened by screws.

The central locking control hub comprises a key to lock and unlock the hub. In the preferred embodiment, the key is a T shaped key and the top of the T shape is contoured to fit comfortably in the palm of the operator's hand. The base of the key is preferably a square with detent holes in the four sides to engage a matching detent ball in the matching key receptacle in the central locking control hub. Alternatively, the key does not have to be temporarily locked into the central locking control hub when engaged. The key receptacle could be on either the bottom or top of the central locking control hub, or a receptacle could be on each side. The preferred embodiment comprises a key that resembles a T shaped handle, however a configuration using a standard hex key is possible. Alternatively, the key can be non-removable and can be part of the housing.

The key receptacle is attached to the cam that is displaced in a cylindrical opening at the center of the housing of the central locking control hub. Alternatively, the cam is mounted in the housing using ball bearings in the housing of the central locking control hub.

The cam has a plurality of cam lobes used to engage the locking pistons. In the preferred embodiment there are 8 cam lobes equally spaced from each other. A groove is situated in the top side of the cam and the groove continues along the perimeter of the cam for receiving each engaging pin of the corresponding locking piston such that the rotation of the cam will move the locking piston engaging pin along the cam channel thereby moving the locking piston along the cylinder formed in the housing of the central locking control hub. Alternatively, each locking piston could be spring loaded and the cam could use the face of each lobe to force the locking piston along the cylinder to be later returned by the spring.

Each locking piston engages a corresponding pivot mount that is preferably rotatably connected to the housing of the central locking control hub by a pin mounted in a channel in the housing of the central locking control hub. The pivot mount preferably comprises an inner end that is cylindrical from a side view and an outer end that attaches to the corresponding support rib. The pin is situated in a cylindrical opening in the center of the pivot mount that allows the pivot mount to pivot about the pin in a vertical plane from the central locking control hub. Each pivot mount may independently pivot vertically at different angles from the central locking control hub. Each pivot mount is rotatably connected to the housing of the central locking control hub toward the outer end of a cylinder formed in the housing of the central locking control hub. In the preferred embodiment, the inside cylindrical end of the pivot mount comprises a plurality of teeth of a gear. The portion of the locking piston situated away from the cam is then configured with a partial inside cylinder with teeth to engage the teeth of the pivot mount.

Alternatively, the matching surfaces of the locking piston and the pivot mount could be engaged by friction on a surface such as rubber mating surfaces. Furthermore the matching surfaces of the locking piston and the pivot mount could be engaged by a tapered pin on the end of the locking piston and a matching receptacle on the inside end of the pivot mount. Alternatively, the support ribs can be connected to the central locking control hub via a ratchet mechanism. Accordingly, the support ribs would not release under the force of gravity when the key is turned to the unlocked position, but would require some additional force.

Alternatively, the central locking control hub may use means other than a cam to engage the plurality of locking pistons with the corresponding pivot mounts in order to lock each pivot mount into a particular angle from the horizontal plane. A closed hydraulic system would comprise a pump or spring loaded piston that would create hydraulic pressure forcing a spring loaded locking pin to engage a pivot mount, thereby locking the pivot mount in place.

The reconfigurable sun shade and shelter apparatus includes a flexible shade cover that is substantially square and may be opaque, partially opaque or translucent. The flexible shade cover may be removable for ease of cleaning. The flexible shade cover may be waterproof to provide shelter from rain. The flexible shade cover may incorporate a vent system to provide stability in high winds. The shade cover may be constructed of various materials including fabric, stretch fabric, coated fabric, canvas, plastic, stretch plastic, nylon, polyvinyl and other materials such as those useful for constructing tents and umbrellas. Furthermore, the flexible shade cover may comprise several panels which may have varied levels of opacity and may be suitable for presenting advertisements. Furthermore, the flexible shade cover may comprise a plurality of panels that may independently be replaced with spare panels allowing for changing opacity or advertisements. Additionally, the shade cover may include interior pockets or hooks.

The flexible shade cover is attached to a plurality of support ribs. The support ribs are preferably fiberglass and may be constructed of a variety of materials such as those used in tent manufacture including plastic, fiberglass and aluminum alloys. Due to the square configuration of the flexible shade cover, the first preferred embodiment comprises 8 support ribs, 4 shorter ribs displaced at 0, 90, 180 and 270 degrees and 4 longer ribs displaced at 45, 135, 225 and 315 degrees. Each support rib is attached to a corresponding pivot mount that has an inner end that is pivotally connected to the housing of the central locking control hub. The pivot mount can be attached to the ribs by adhesive, a screw arrangement as in plumbing pipes or other coupling means such as a sleeve connected to each piece. Alternatively, the support ribs and pivot mount may be constructed in one piece.

Alternatively, the outer end of each support rib may comprise a support pole mount for fastening a support pole, fastening rope or tent stake and a removable cover for each support pole mount. The removable support rib cover can be constructed of a soft rubber material press fit over the end of the support rib or a cover that screws onto the end of the support rib. Additionally, clips or other fasteners may be provided to secure adjacent panels when so configured in order to provide additional structural support. The support ribs may have ends suitable for use as a spike to secure the apparatus in sand.

The fiberglass support ribs can be covered with a flexible shade cover comprising a substantially square sheet of material, such as a stretchable waterproof fabric or preferably stretch plastic such as nylon, and strips of material, preferably nylon, bonded to the top sheet forming support pole channels. The removable flexible shade cover can be mounted to the support ribs using a hook and loop fastener such as Velcro or other fastener such as snap fasteners.

The housing of the central locking control hub comprises a mount for a support pole allowing the reconfigurable sun shade and shelter apparatus to be configured as an umbrella. The mount can be a high-resistance universal pivot mount.

In a first preferred embodiment, the reconfigurable sun shade and shelter apparatus includes a flexible shade cover that is substantially square. The flexible shade cover is attached to 8 support ribs and a central locking control hub by fasteners and can be removed. The support ribs each have an inside end that is connected to an outer end of a corresponding pivot mount using a removable sleeve. Each pivot mount is pivotally connected to a housing of a central locking control hub using a metal pin and nylon washers. The other parts of the central locking control hub are constructed of plastic. The central locking control hub comprises a cam and key to actuate the cam. The cam has a cam channel in which a plurality of locking pistons are slidably connected to the cam channel, thereby allowing the 8 support ribs to be locked at various vertical angles from the horizontal plane of the central locking control hub.

Preferably, the reconfigurable sun shade and shelter apparatus comprises 8 support ribs, preferably constructed from fiberglass, that are spaced at substantially 45 degree angles from each other and each pivotally attached to a central locking control hub, resembling spokes from a wheel hub. The fiberglass support ribs can pivot vertically from the central locking control hub, thereby causing the flexible shade cover to be repositioned and thereby reconfiguring the sun shade and shelter apparatus. The fiberglass support ribs are covered with a flexible shade cover comprising a substantially square sheet of material, preferably a stretchable waterproof fabric or stretch plastic such as nylon and fastened to the support ribs using Velcro fasteners or other suitable fasteners such as snaps, zippers or glue. Due to the substantially square shape, the four corner support ribs are longer than the four central support ribs. The central locking control hub comprises metal pivot pins, nylon washers and remaining parts made of plastic. The central locking control hub further comprises a cam with a cam channel, 8 locking pistons and 8 pivot mounts situated in the 8 cylinders, each pivot mount and locking piston having teeth that mate on the matching surface in the cylinder, pivot pins to connect the pivot mount to the housing and a key to operate the cam.

In a second embodiment, the reconfigurable sun shade and shelter apparatus has a bottom sheet that is sewn or bonded to the top sheet with the support ribs in between the two sheets and an opening for the cam key.

In another embodiment, the central locking control hub comprises a mount for a vertical support pole on the bottom.

In a fourth embodiment, the central locking control hub comprises pin locking means comprising a plurality of locking pistons each with a tapered pin and a plurality of pivot mounts each with a corresponding socket to engage the lock of the central locking control hub.

In a fifth embodiment, the central locking control hub comprises pivot locking means comprising friction coupling means coupling the support pole mounts to the central locking control hub.

In a sixth embodiment, the central locking control hub comprises a pivot locking means comprising a ratchet coupling means coupling the support pole mounts to the central locking control hub.

In a seventh embodiment, the reconfigurable sun shade and shelter apparatus comprises a plurality of central locking control hubs.

Furthermore, the reconfigurable sun shade and shelter apparatus has many configurations that would result in shade panels visible to a person walking by. While the traditional umbrella may not be effective for advertisements, the reconfigurable sun shade and shelter apparatus may have replaceable shade panels that could carry advertisements. Similarly, several substantially opaque panels could be replaced by translucent panels or partially translucent panels to allow occupants of the reconfigurable structure to see through the device.

The embodiments described in the present invention may be beneficially utilized as a reconfigurable structure for use as a sun shade and for illustrative purposes in several embodiments, reference will be made to such application. However, a reconfigurable structure for use as a sun shade is not the exclusive application for this invention and it is to be understood that this invention could be used in other applications such as for temporary accommodation and protection from other elements such as wind and rain.

In another embodiment, shown in FIGS. 14–25, a reconfigurable reflective apparatus is described.

As can be appreciated, the reflective materials might be white, silver or other reflective color. The light sources utilized by a particular artist could be tinted or the reflective materials could be translucent. Still photography photographers traditionally utilize light reflectors. Additionally, motion picture cinematographers and videographers may utilize reflectors. Artists lighting a scene in order to paint or sketch the scene may also use them. A reconfigurable reflective apparatus might be useful if it is free standing. Similarly it might be useful if it could be easily carried.

As can be appreciated, a flat reflector with a large surface area and small depth might be useful. For example a reflector that could be placed flat on the ground or angled from a centerline might be useful. Similarly, such a flat reflector might be suspended from a ceiling or other support. Such a reflector might be useful in blocking wind, but as can be appreciated, could include openings to allow wind to pass through. A large reconfigurable reflective apparatus could be utilized in a corner, could incrementally add light to a scene, could be leaned against a wall and carried by one person. As can be appreciated, it could be mounted on a stand or tripod with extension and manipulated into various positions. Additionally, interchangeable reflector covers could be utilized.

Such reconfigurable reflective devices could bejoined to create larger reflectors.

The respective illustrative embodiments are described in detail with reference to the Figures. Such embodiments are illustrative and the alternatives described herein are intended to describe alternative embodiments.

A reconfigurable sun shade and shelter apparatus 2 is illustrated in FIGS. 1 to 10*a*. An alternative having two central hubs is shown in FIG. 11. FIGS. 12 and 13 show embodiments in various configurations. A reconfigurable reflective apparatus 102 is described with reference to FIGS. 14–25.

Reconfigurable sun shade and shelter apparatus 2 comprises a flexible shade cover that is substantially square 4 attached to a plurality of support ribs 6 and 8 and a central locking control hub 10, the support ribs 6, 8 each having an inside end 6*a*, 8*a* that is pivotally connected to the central locking control hub 10 and an outside end 6*b*, 8*b* that is removably connected to the flexible shade cover 4. The central locking control hub 10 further comprising locking pivot means for independently pivoting each of the plurality of support ribs 6, 8 such that each support rib can independently be positioned in any one of a plurality of pivot positions and be locked into that pivot position, the central locking control hub 10 further including means for receiving a central support pole 80.

Figure 9A:
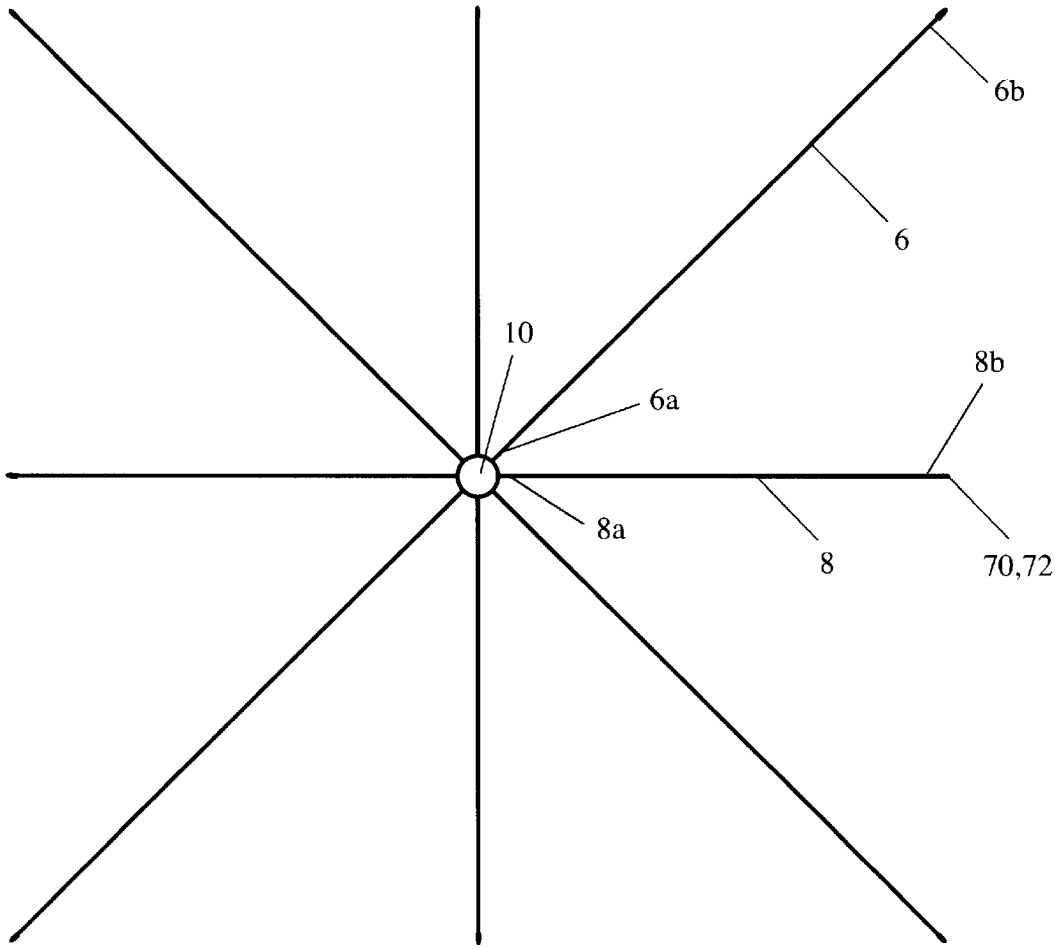
FIG. 9*a* is a top view of a central locking control hub and support ribs according to an embodiment of the present application.

As shown in FIG. 9, the reconfigurable sun shade and shelter apparatus 2 comprises eight (8) support ribs 6, 8. The support ribs comprising four (4) long corner support ribs displaced at 45, 135, 225 and 315 degrees 6 and four (4) short side support ribs 8 displaced at 0, 90, 180 and 270 degrees. The support ribs 6, 8 are preferably constructed of fiberglass. The support ribs 6, 8 are preferably approximately spaced at 45 degree angles from each other and each pivotally attached to a central locking control hub 10, resembling spokes from a wheel hub. The fiberglass support ribs 6, 8 can pivot vertically from the central locking control hub 10, thereby causing the flexible shade cover 4 to be repositioned and thereby reconfiguring the sun shade and shelter apparatus. Each support rib 6, 8 is attached to a corresponding pivot mount 40 that has an inner end 42 that is pivotally connected to the housing 11 of the central locking control hub 10.

Figure 9B:
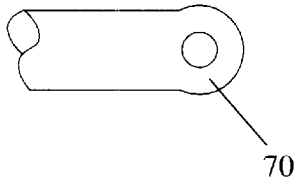
FIG. 9*b* is a side view of an outside end of a support rib according to an embodiment of the present application.
Figure 9C:
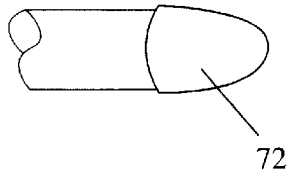
FIG. 9*c* is a side view of an outside end of a support rib with cap according to an embodiment of the present application.

As shown in FIGS. 9*b*–9*c*, the outer end of each support rib 6, 8 comprises a support pole mount 70 for fastening a support pole, fastening rope or tent stake and a removable cover for each support pole mount. The removable support rib cover 72 is constructed of a soft rubber material press fit over the end of the support rib 6,8.

Figure 2:
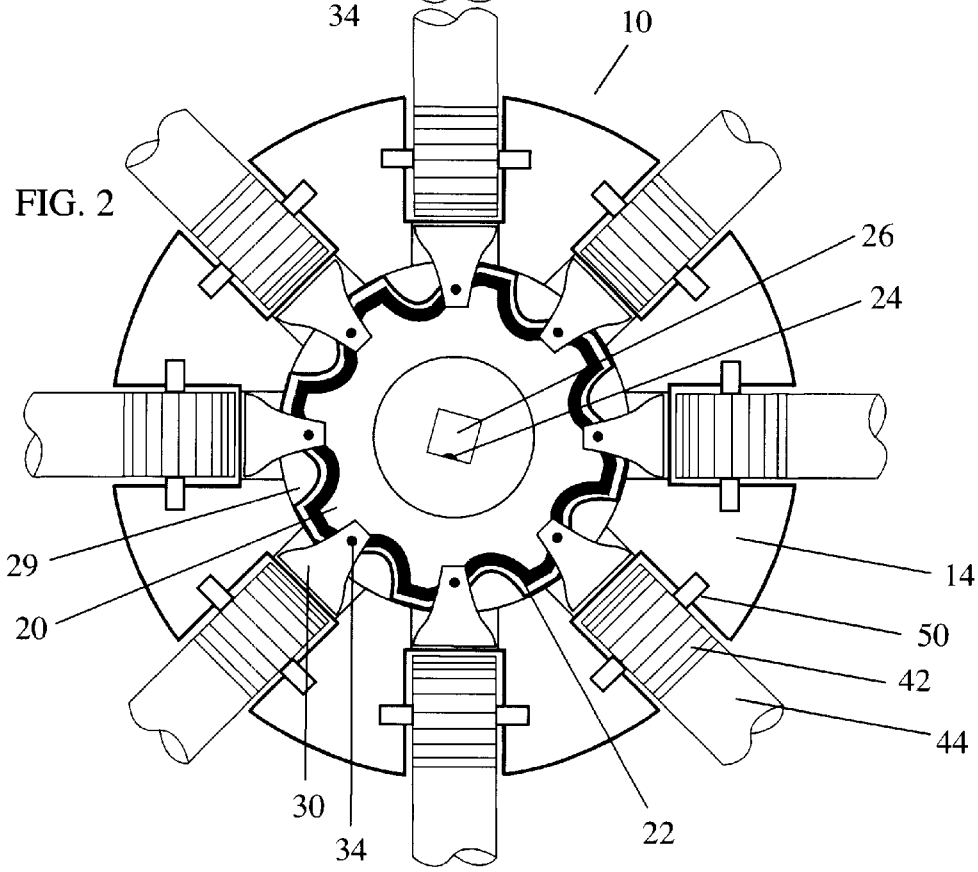
FIG. 2 is a top view with cut away of a central locking control hub in unlocked position of a reconfigurable sun shade and shelter apparatus, where the engaging pin of the locking pistons have traveled along the cam channel according to an embodiment of the present application.
Figure 3A:
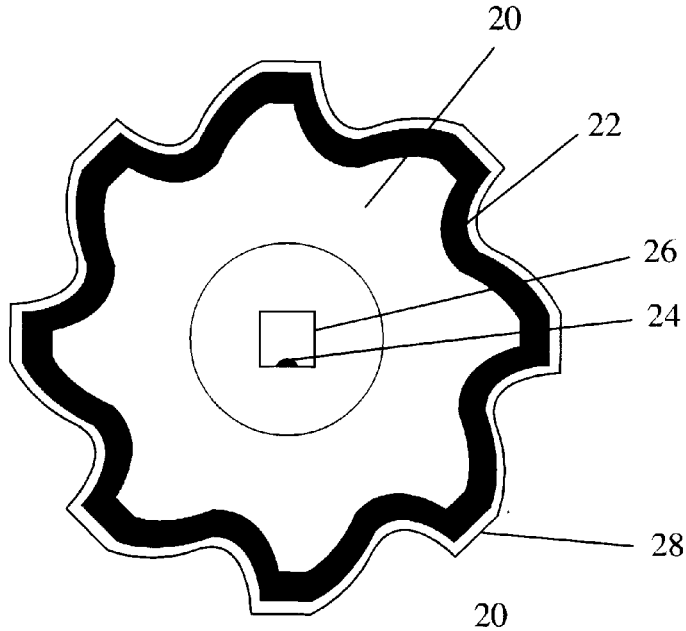
FIG. 3*a* is a top view of a cam, according to an embodiment of the present application.
Figure 3B:
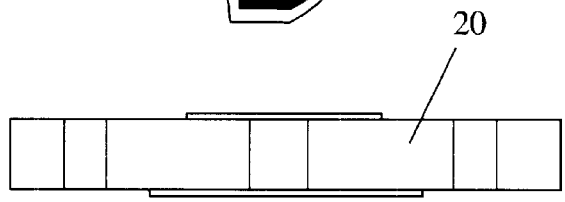
FIG. 3*b* is a side view of a cam according to an embodiment of the present application.
Figure 3C:
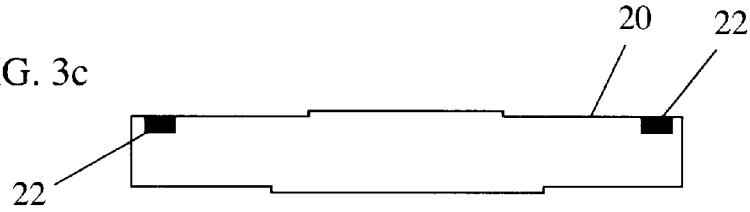
FIG. 3*c* is a side cutaway view of a cam according to an embodiment of the present application.
Figure 3D:
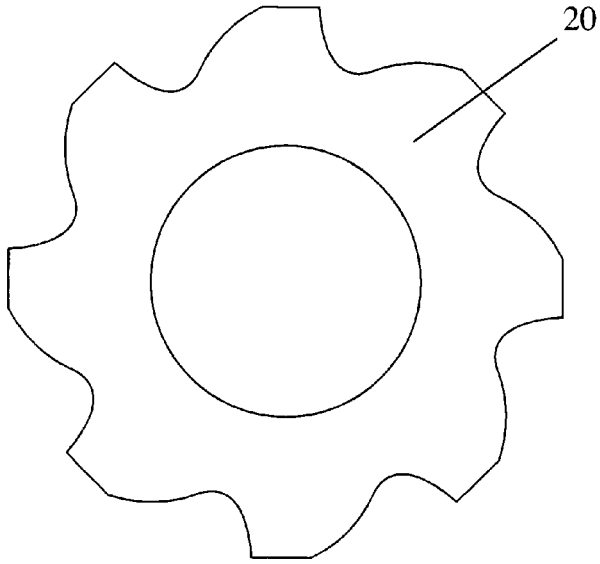
FIG. 3*d* is a bottom view of a cam according to an embodiment of the present application.
Figure 7A:
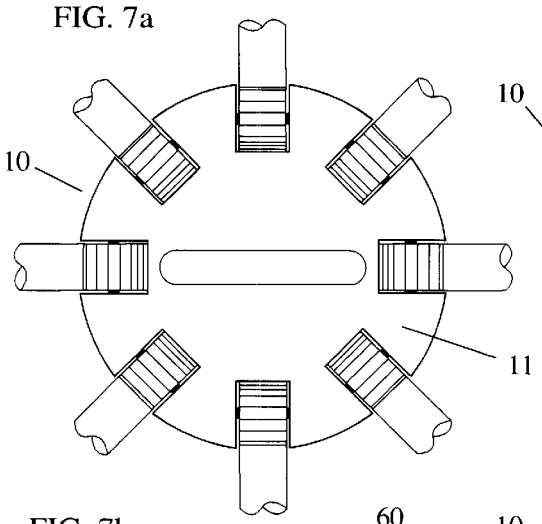
FIG. 7*a* is a top view of a central locking control hub according to an embodiment of the present application.
Figure 7D:
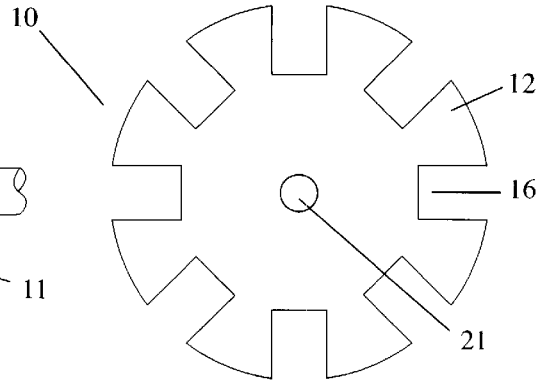
FIG. 7*d* is a top view of a top housing half according to an embodiment of the present application.
Figure 7B:
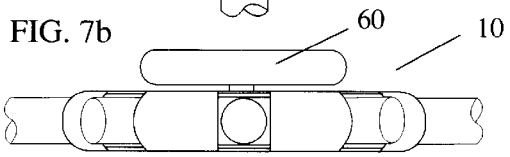
FIG. 7*b* is a side view of a central locking control hub according to an embodiment of the present application.
Figure 7E:
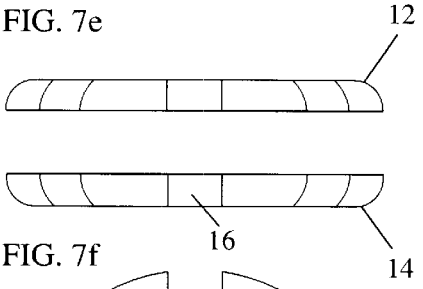
FIG. 7*e* is a side view of top and bottom housing halves according to an embodiment of the present application.
Figure 7C:
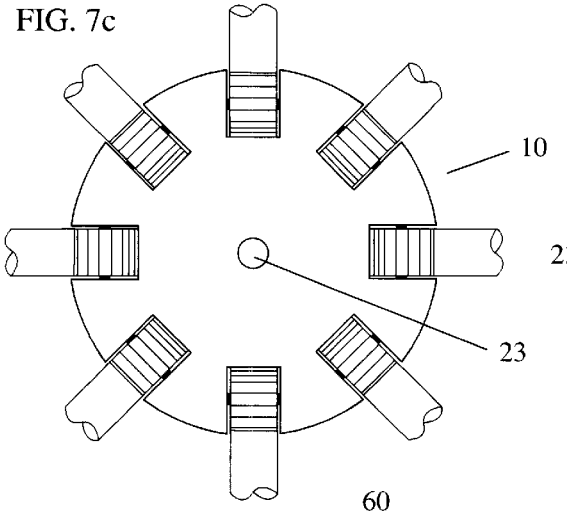
FIG. 7*c* is a bottom view of a central locking control hub according to an embodiment of the present application.
Figure 7F:
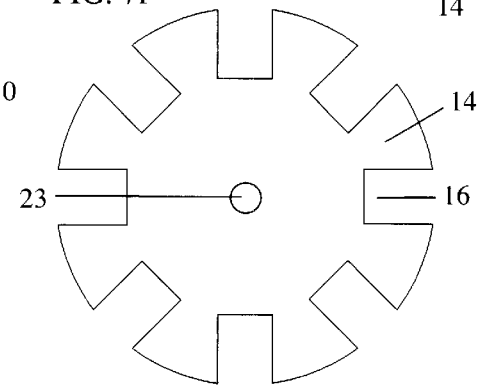
FIG. 7*f* is a bottom view of a bottom housing half according to an embodiment of the present application.
Figure 8A:
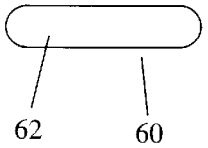
FIG. 8*a* is a top view of a key according to an embodiment of the present application.
Figure 8B:
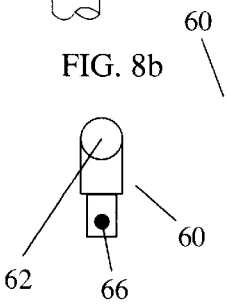
FIG. 8*b* is a front view of a key according to an embodiment of the present application.
Figure 8C:
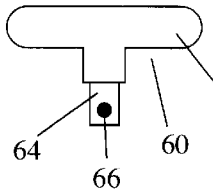
FIG. 8*c* is a side view of a key according to an embodiment of the present application.
Figure 8D:
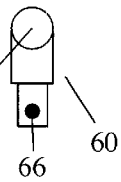
FIG. 8*d* is a rear view of a key according to an embodiment of the present application.
Figure 8E:
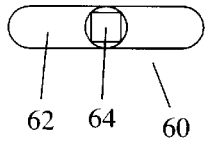
FIG. 8*e* is a bottom view of a key according to an embodiment of the present application.

As shown in FIGS. 1 and 2, the central locking control hub 10 comprises locking devices coupling the pivot mounts to the central locking control hub 10. The central locking control hub further comprises a housing attached to pivot mounts. The locking pistons 30 are connected to cam 20.

The key 60 is removably attached to cam 20. The cam is pivotally connected to the plurality of locking pistons 30 enabling the pivot mounts to be independently locked into one of a plurality of possible positions.

As shown in FIG. 7, the housing 11 comprises two housing halves 12, 14 to create a housing with an opening for a cam 20 and eight (8) cylinders 16.

As shown in FIGS. 7*a*, 7*b*, and 8*a*–8*e*, the central locking control hub 10 comprises a key 60 to lock and unlock the hub. In the preferred embodiment, the key 60 is a T shaped key and the top of the T shape 62 is contoured to fit comfortably in the palm of the operator's hand or between the fingers. The base of the key 64 is preferably a square with detent holes 66 in the four sides to engage a matching detent ball 24 in the matching key receptacle 26 in the central locking control hub 10.

As shown in FIGS. 1 and 3*a*–3*d*, the key receptacle 26 is formed in the cam 20 that is displaced in a cylindrical opening 29 at the center of the housing 11 of the central locking control hub 10. The cam 20 has eight (8) cam lobes 28 equally spaced from each other. A groove 22 is situated in the top side of the cam 20 and the groove 22 continues along the perimeter of the cam 20.

As shown in FIGS. 1, 3, 4*a*–4*e*, 7*d* and 7*f*, the groove 22 continues along the perimeter of cam 20 for receiving each engaging pin 34 of the corresponding locking piston 30 such that the rotation of the cam 20 will move the locking piston engaging pin 34 along the cam groove 22 thereby moving the locking piston 30 along the cylinder 16 formed in the housing 11 of the central locking control hub 10. Each locking piston 30 has teeth 32.

As shown in FIGS. 1, 5*a*–5*e*, 6*a*–6*b*, 7*a*, 7*c*, 7*d* and 7*f*, each locking piston 30 engages a corresponding pivot mount 40 that is rotatably connected to the housing 11 of the central locking control hub by a pin 50 mounted in a channel in the housing 11 of the central locking control hub 10. The pivot mount comprises an inner end 42 that is cylindrical from a side view and an outer end 44 that attaches to the corresponding support rib. The pin 50 is situated in a cylindrical opening 46 in the center of the pivot mount 40 that allows the pivot mount 40 to pivot about the pin 50 in a vertical plane from the central locking control hub 10. Each pivot mount 40 can independently pivot vertically at different angles from the central locking control hub 10. Each pivot mount 40 is rotatably connected to the housing 11 of the central locking control hub 10 toward the outer end of a cylinder 16 formed in the housing 11 of the central locking control hub 10. The inside cylindrical end 42 of the pivot mount comprises a plurality of teeth of a gear 48. The portion of the locking piston 30 situated away from the cam is then configured with a partial inside cylinder with teeth 32 to engage the teeth of the pivot mount.

Figure 10A:
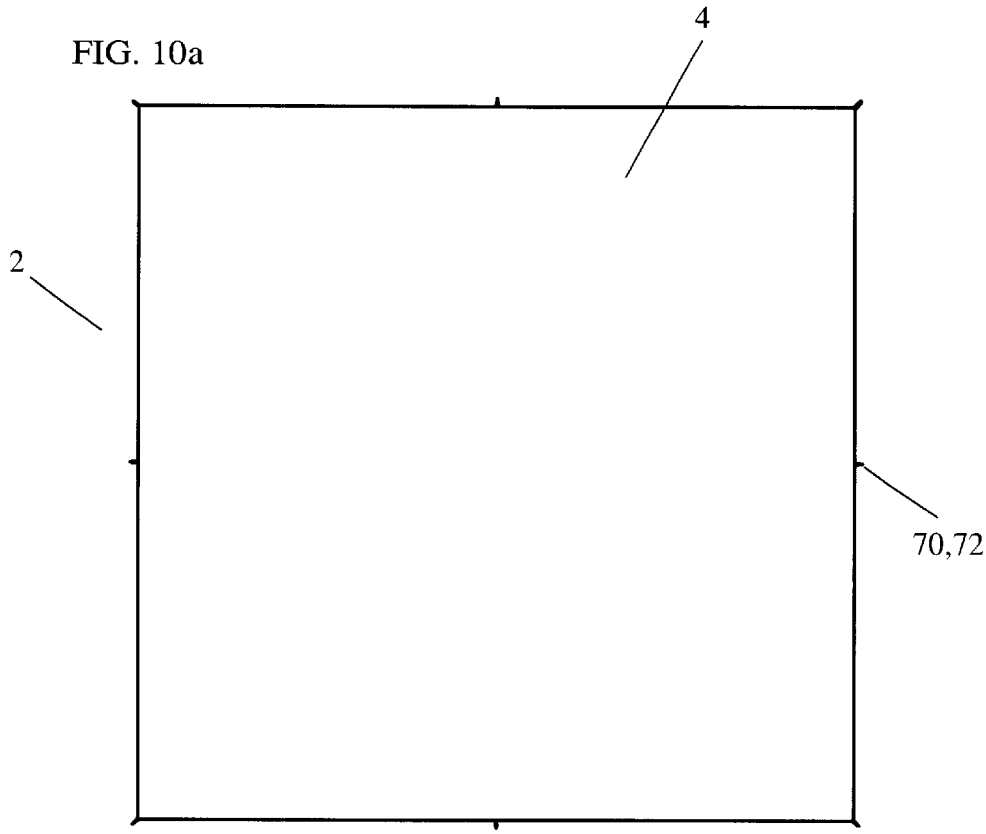
FIG. 10*a* is a top view of a reconfigurable sun shade and shelter apparatus according to an embodiment of the present application.
Figure 11:
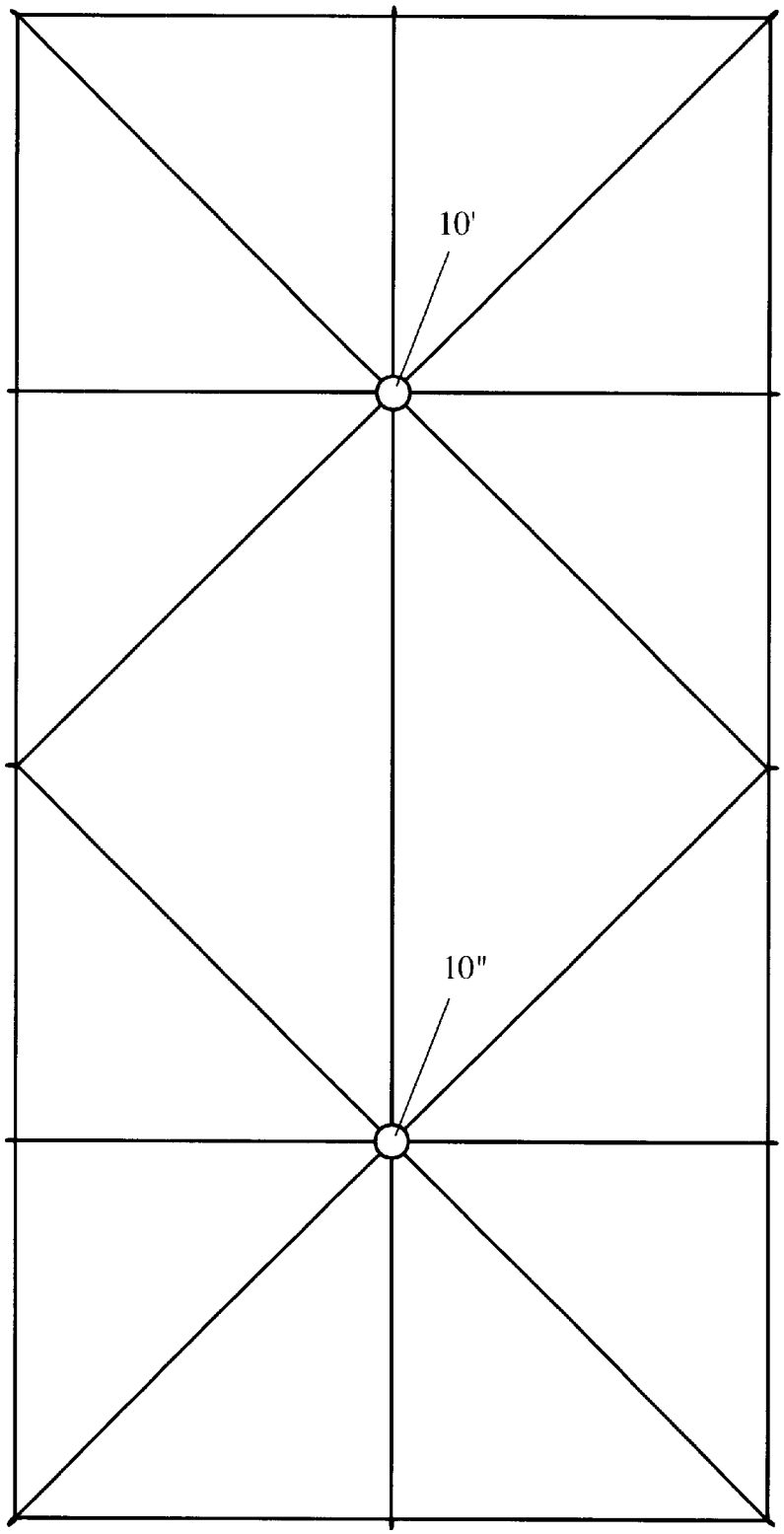
FIG. 11 is a bottom view of a reconfigurable sun shade and shelter apparatus having two central locking control hubs according to an embodiment of the present application.
Figure 12A:
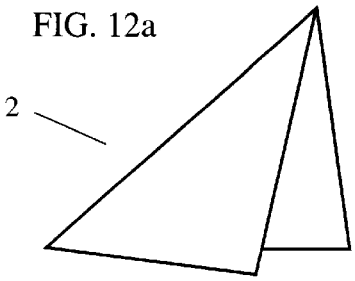
FIG. 12*a* is an angled side view of a reconfigurable sun shade and shelter apparatus in one fixed position according to an embodiment of the present application.
Figure 12D:
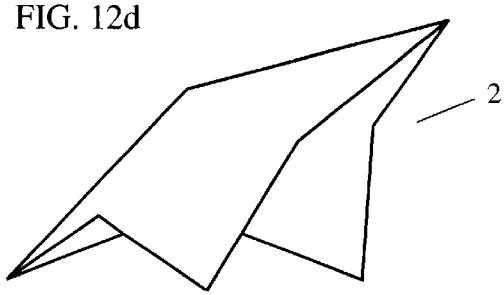
FIG. 12*d* is an angled side view of a reconfigurable sun shade and shelter apparatus in one fixed position according to an embodiment of the present application.
Figure 12B:
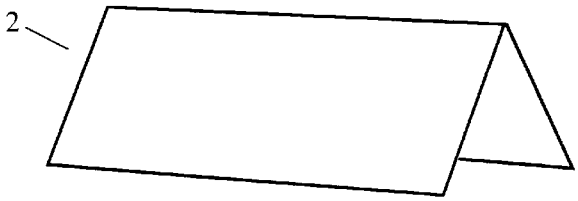
FIG. 12*b* is an angled side view of a reconfigurable sun shade and shelter apparatus in one fixed position according to an embodiment of the present application.
Figure 12E:
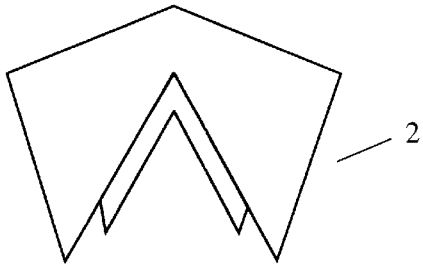
FIG. 12*e* is an angled side view of a reconfigurable sun shade and shelter apparatus in one fixed position according to an embodiment of the present application.
Figure 12C:
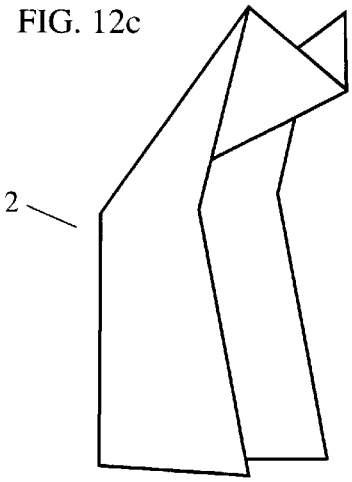
FIG. 12*c* is an angled side view of a reconfigurable sun shade and shelter apparatus in one fixed position according to an embodiment of the present application.
Figure 12F:
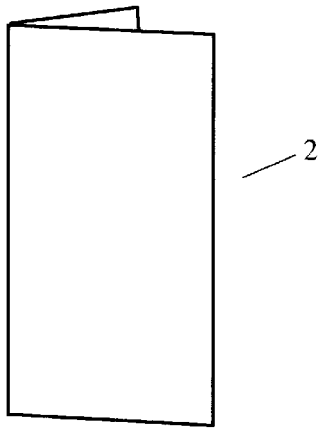
FIG. 12*f* is an angled side view of a reconfigurable sun shade and shelter apparatus in one fixed position according to an embodiment of the present application.
Figure 13A:
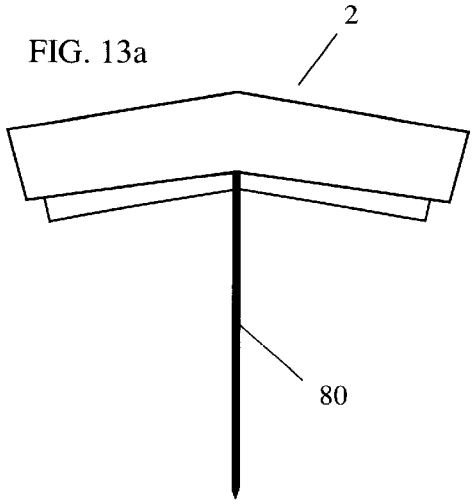
FIG. 13*a* is a side view of a reconfigurable sun shade and shelter apparatus with support pole in one fixed position according to an embodiment of the present application.
Figure 13D:
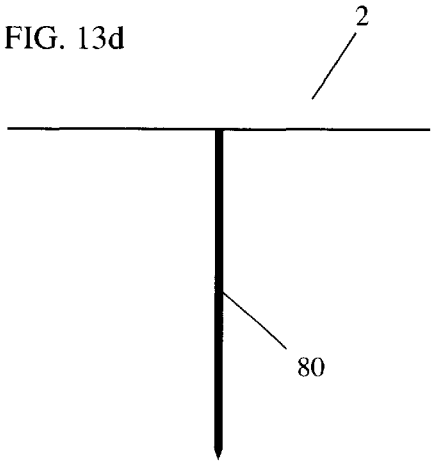
FIG. 13*d* is a side view of a reconfigurable sun shade and shelter apparatus with support pole in one fixed position according to an embodiment of the present application.
Figure 13B:
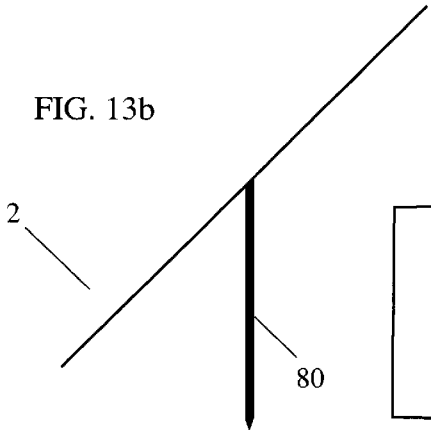
FIG. 13*b* is a side view of a reconfigurable sun shade and shelter apparatus with support pole in one fixed position according to an embodiment of the present application.
Figure 13E:
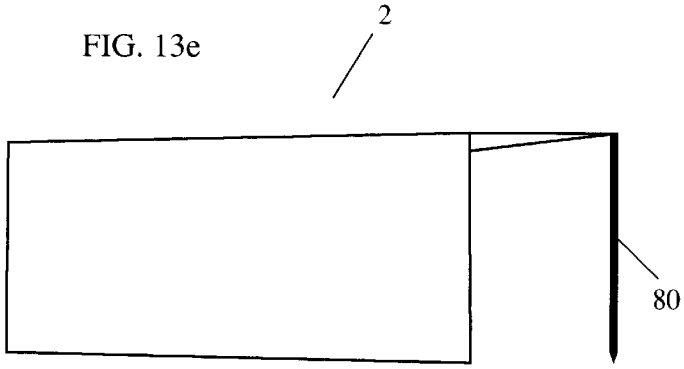
FIG. 13*e* is an angled view of a reconfigurable sun shade and shelter apparatus with support poles in one fixed position according to an embodiment of the present application.
Figure 13C:
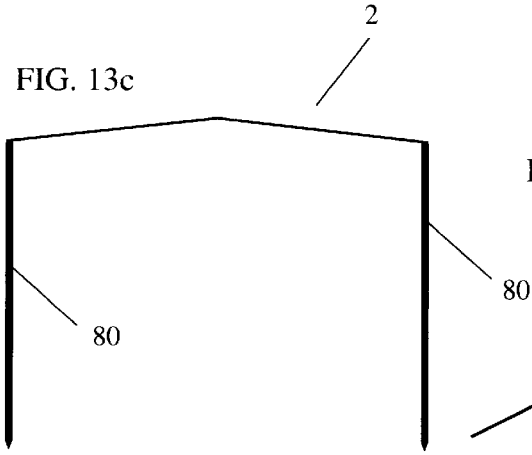
FIG. 13*c* is a side view of a reconfigurable sun shade and shelter apparatus with support poles in one fixed position according to an embodiment of the present application.
Figure 13F:
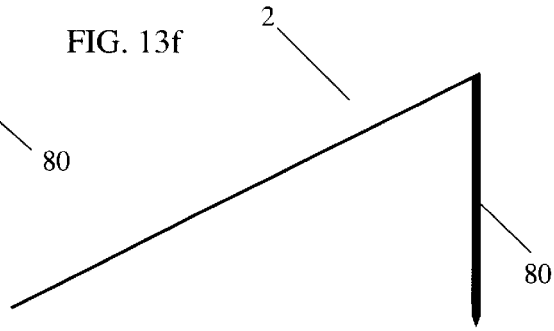
FIG. 13*f* is a side view of a reconfigurable sun shade and shelter apparatus with support poles in one fixed position according to an embodiment of the present application.

As shown in FIG. 10*a*, the reconfigurable sun shade and shelter apparatus 2 includes a flexible shade cover 4 that is substantially square.

Figure 10B:
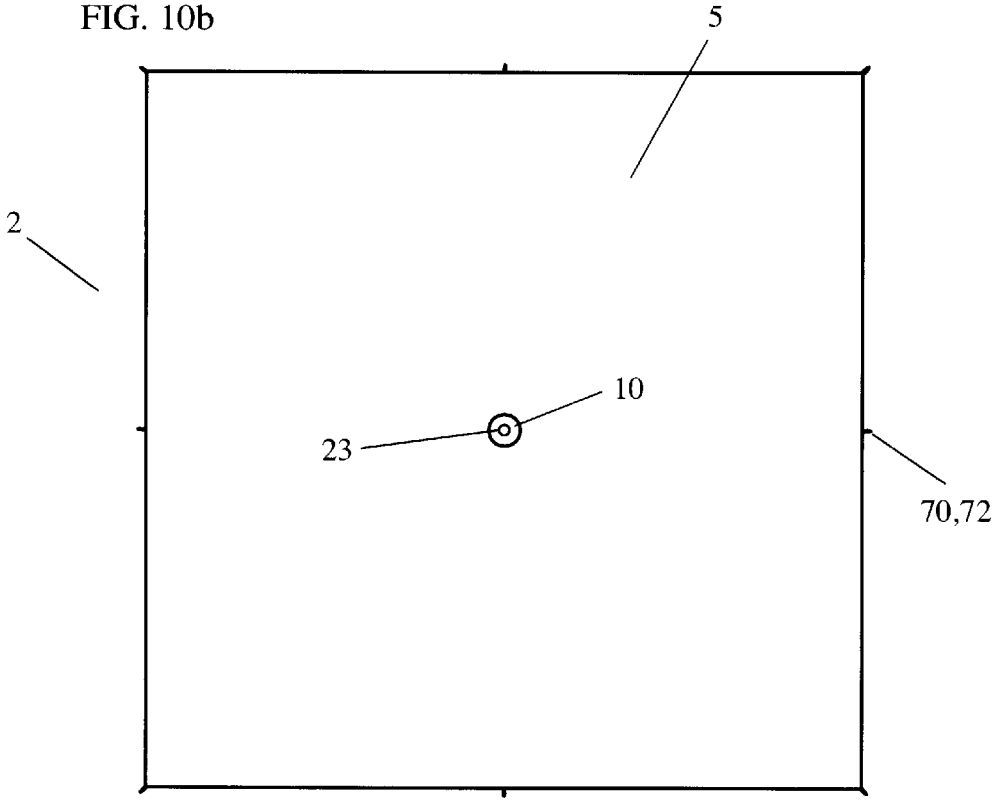
FIG. 10*b* is a bottom view of a reconfigurable sun shade and shelter apparatus according to an embodiment of the present application.

As shown in FIG. 10*b*, in a second embodiment, the reconfigurable sun shade and shelter apparatus 2 has a bottom sheet 5 that is bonded to the top sheet 4 with the support ribs 6, 8 in between the two sheets and an opening for the cam key.

As shown in FIG. 10*b*, the central locking control hub 10 comprises receiving means 23 for a vertical support pole 80 on the bottom.

As shown in FIG. 11, in a seventh embodiment, the reconfigurable sun shade and shelter apparatus comprises a plurality of central locking control hubs.

As shown in FIGS. 12*a*–12*f* and 13*a*–13*f*, the reconfigurable sun shade and shelter apparatus can be reconfigured into a variety of shapes.

A reconfigurable reflective apparatus 102 is shown with reference to FIGS. 14–25.

Figure 14A:
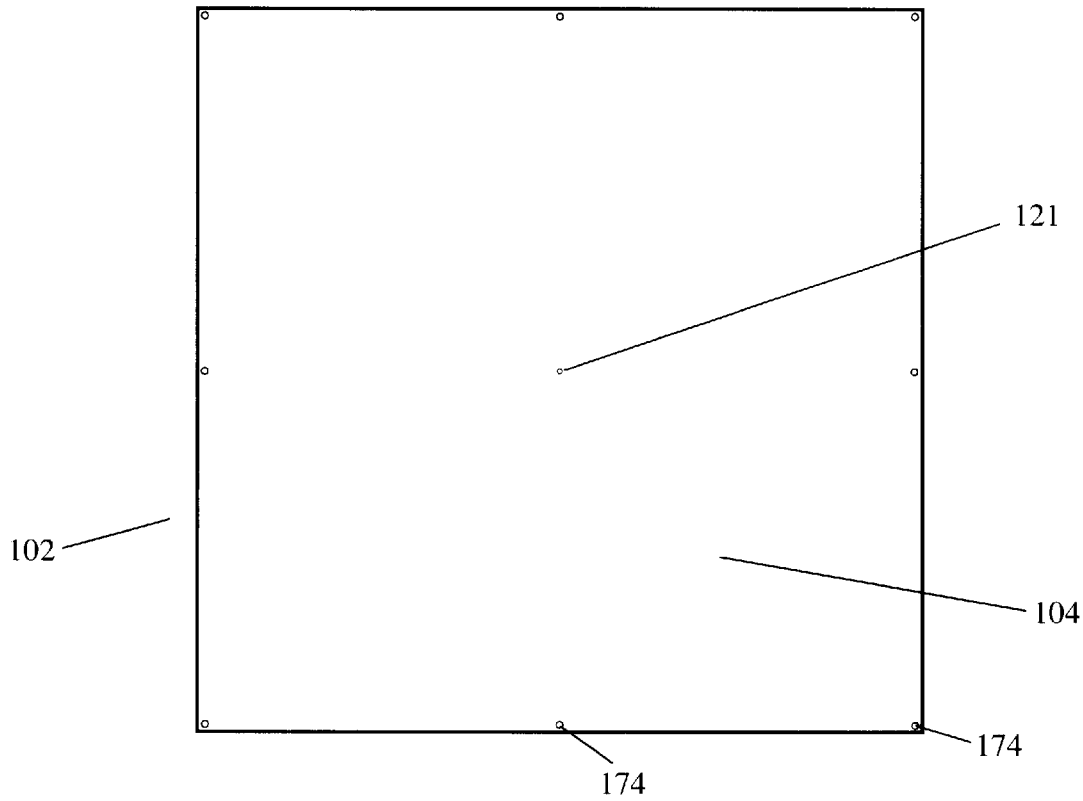
FIG. 14*a* is a top view of a reconfigurable reflective apparatus according to an embodiment of the present application.
Figure 14B:
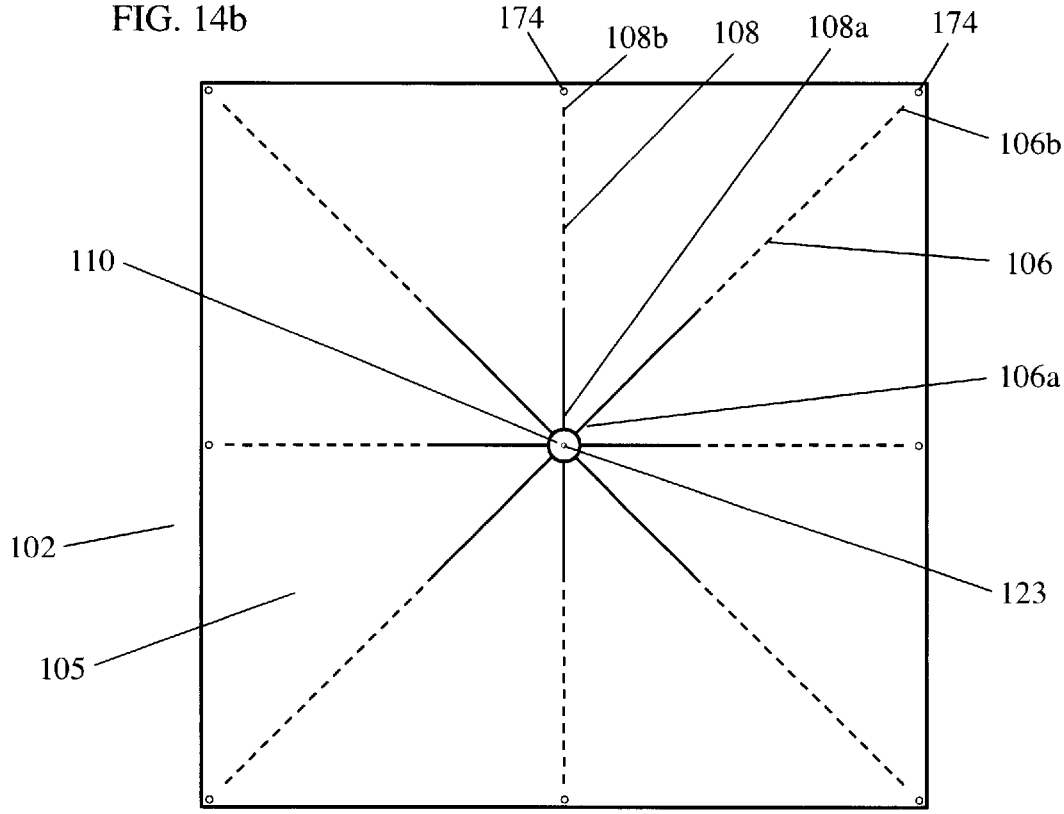
FIG. 14*b* is a bottom view of a reconfigurable reflective apparatus according to an embodiment of the present application.

As shown in FIGS. 14*a*–14*b*, the reconfigurable reflective apparatus 102 comprises a flexible reflector 104 that is substantially square attached to a plurality of support ribs 106 and 108 and a central hub 110, the support ribs 106, 108 each having an inside end 106*a*, 108*a* that is pivotally connected to the central hub 110 and an outside end 106*b*, 108*b* that is removably connected to the flexible reflector 104. The reflector 104 may have a bottom side 105 or pocket to hold the support ribs. The central hub 110 further comprising fixable pivot means for independently pivoting each of the plurality of support ribs 106, 108 such that each support rib can independently be positioned in any one of a plurality of pivot positions and be fixed into that pivot position. A front key hole 121 provides key access. A bottom key hole 123 allows key access. Grommets 174 may be used as mounts. The key hole 123 may be configured as a mount that also allows key access.

Figure 15A:
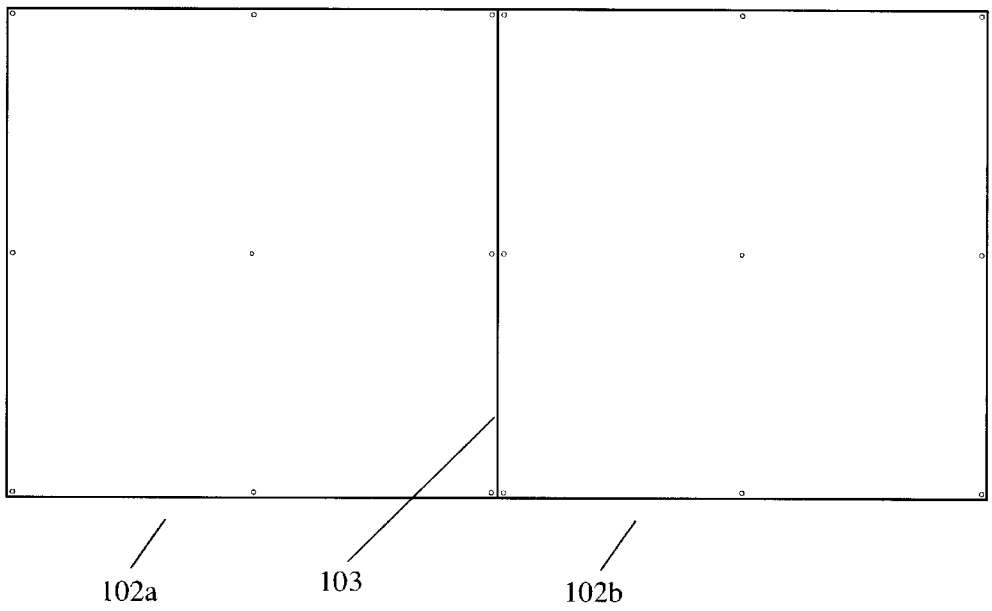
FIG. 15*a* is a top view of a reconfigurable reflective apparatus having two attached reconfigurable devices according to an embodiment of the present application.
Figure 15B:
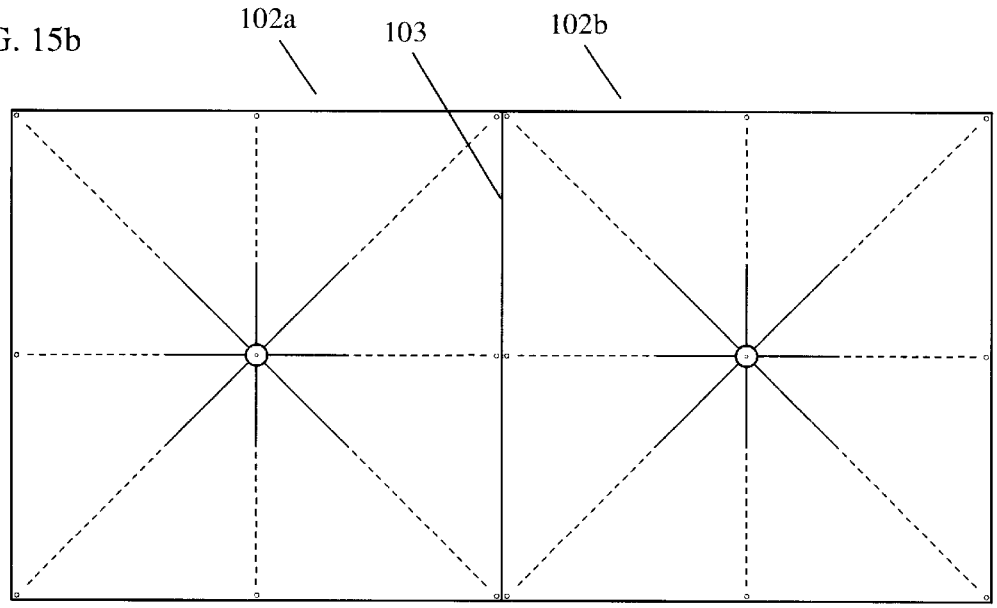
FIG. 15*b* is a bottom view of a reconfigurable reflective apparatus having two attached reconfigurable devices according to an embodiment of the present application.
Figure 16A:
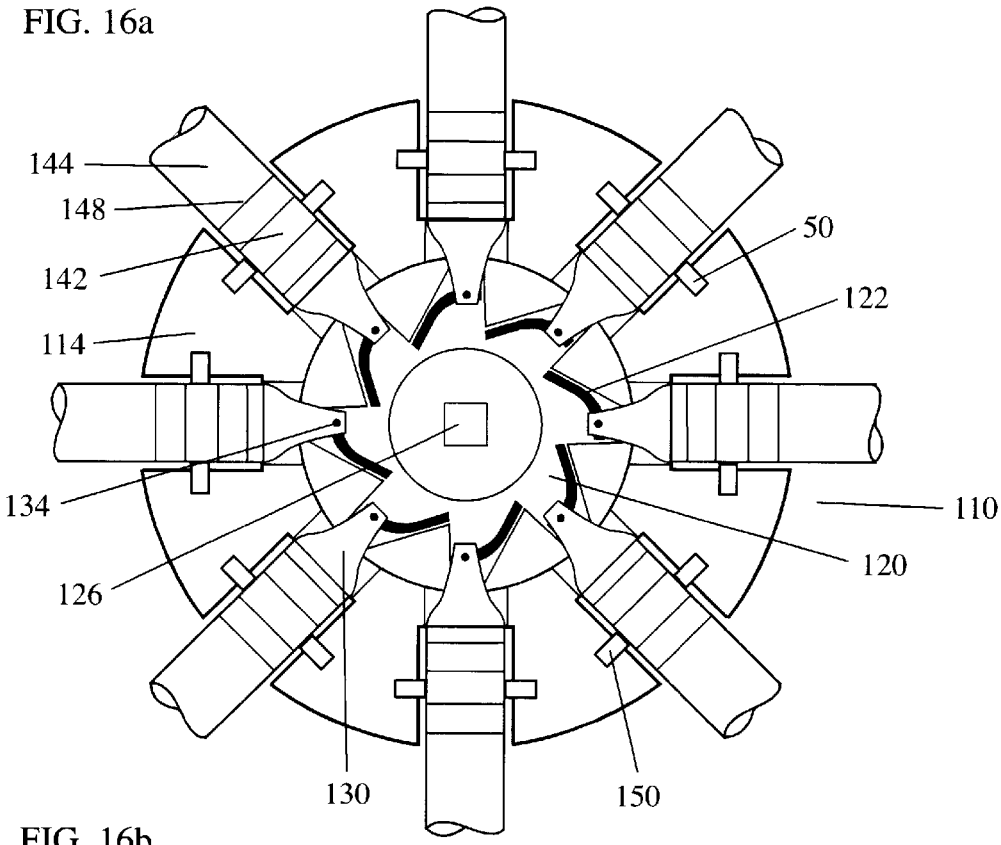
FIG. 16*a* is a top view with cut away of a central locking control hub in locked position of a reconfigurable reflective apparatus according to an embodiment of the present application.
Figure 16B:
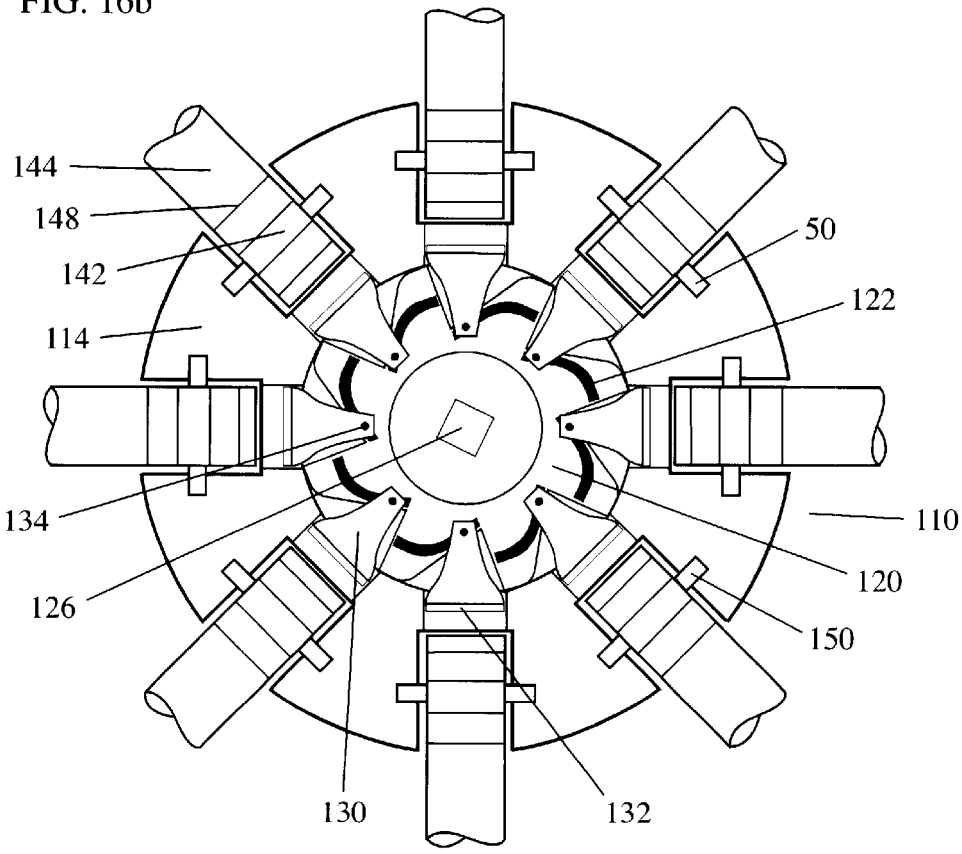
FIG. 16*b* is a top view with cut away of a central locking control hub in unlocked position of a reconfigurable reflective apparatus, wherein the engaging pin of the locking pistons have traveled along the cam channel according to an embodiment of the present application.

As shown in FIGS. 15*a*–15*b*, the reconfigurable reflective apparatus comprises two sections 102*a* and 102*b* that are joined at connection seam 103 that could be fastened using grommets, but could utilize Velcro, snaps or a zipper or other fasteners. FIG. 15*a* shows a top or front view and FIG. 15*b* shows a bottom or back view.

As shown in FIGS. 16*a*, 16*b*, 19*a* and 22*a*, the central locking control hub 110 comprises locking devices coupling the mounts 140 to the central locking control hub 110. The central locking control hub further comprises a housing attached to pivot mount 140. The locking pistons 130 are connected to cam 120. The key 60 is removably attached to cam 120. The cam is pivotally connected to the plurality of locking pistons 130 enabling the pivot mounts 140 to be independently locked into one of a plurality of possible positions. Housing halves 114 and 112 have pin receptacles 151 for pivotally mounting pivot mounts 140 using pins 150.

Figure 17A:
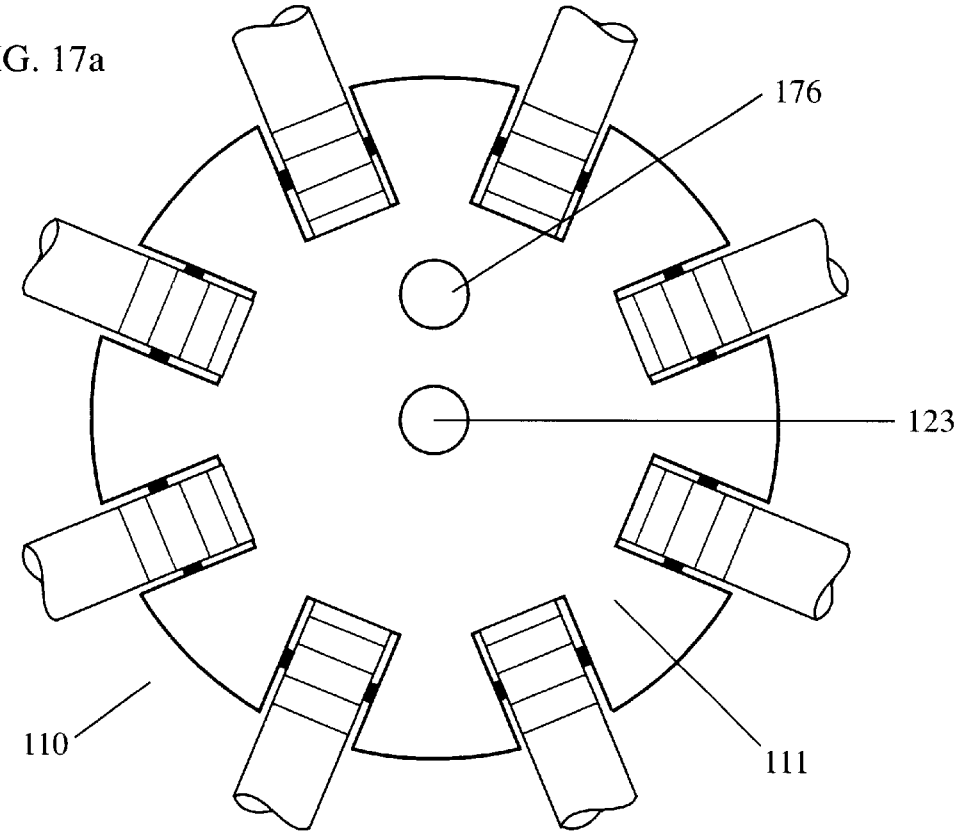
FIG. 17*a* is a bottom view of a central hub having one mounting receptacle according to an embodiment of the present application.
Figure 17B:
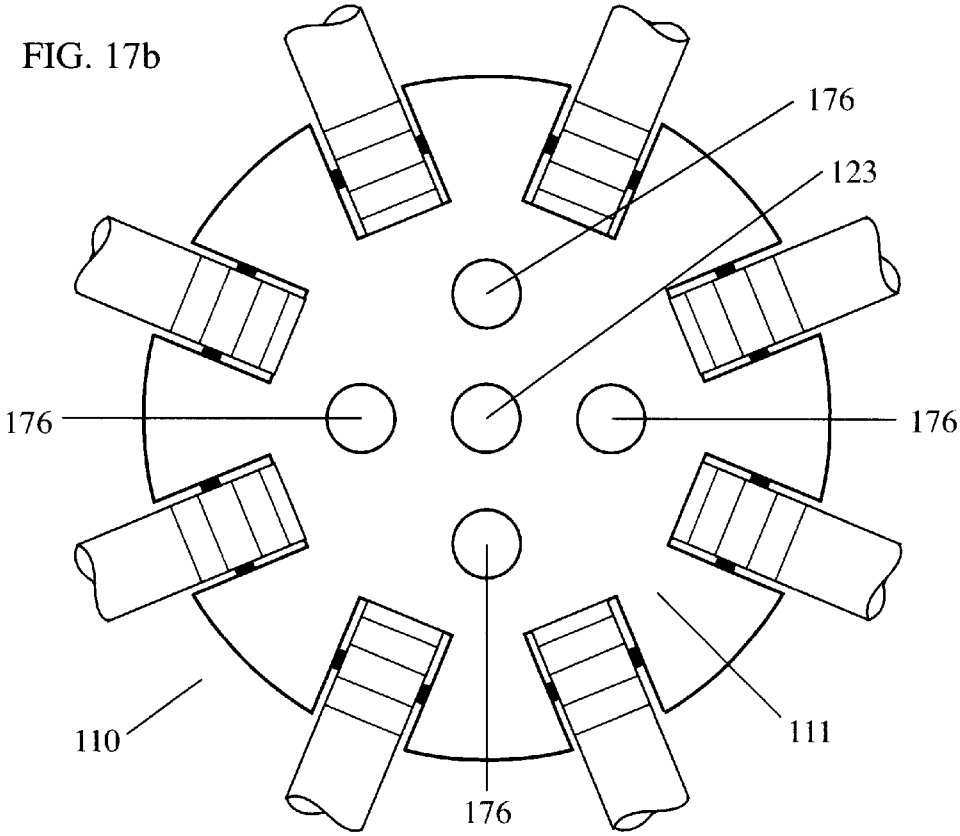
FIG. 17*b* is a bottom view of a central hub having four mounting receptacles according to an embodiment of the present application.
Figure 18A:
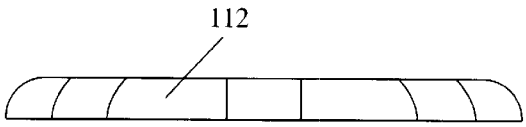
FIG. 18*a* is a side view of a top housing halve according to an embodiment of the present application.
Figure 19A:
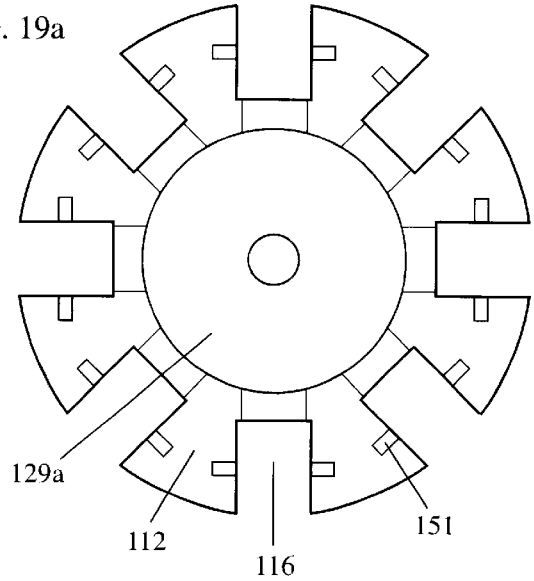
FIG. 19*a* is a bottom view of a top housing halve according to an embodiment of the present application.
Figure 18B:
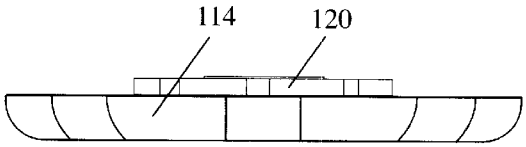
FIG. 18*b* is a side view of a bottom housing halve with cam mounted according to an embodiment of the present application.
Figure 19B:
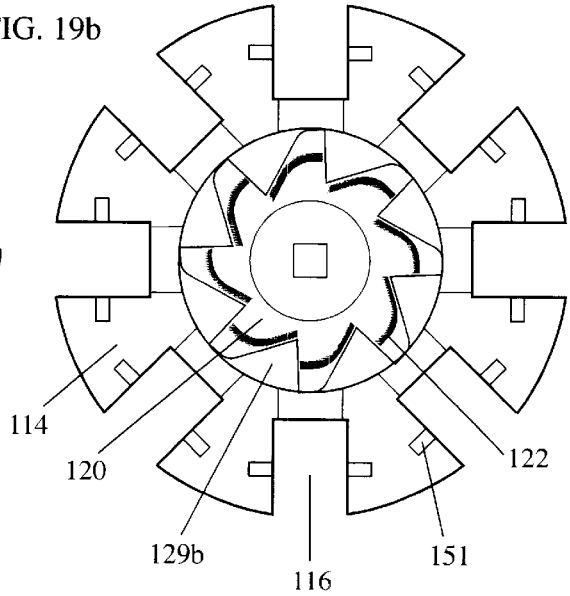
FIG. 19*b* is a top view of a bottom housing halve with cam mounted according to an embodiment of the present application.
Figure 20A:
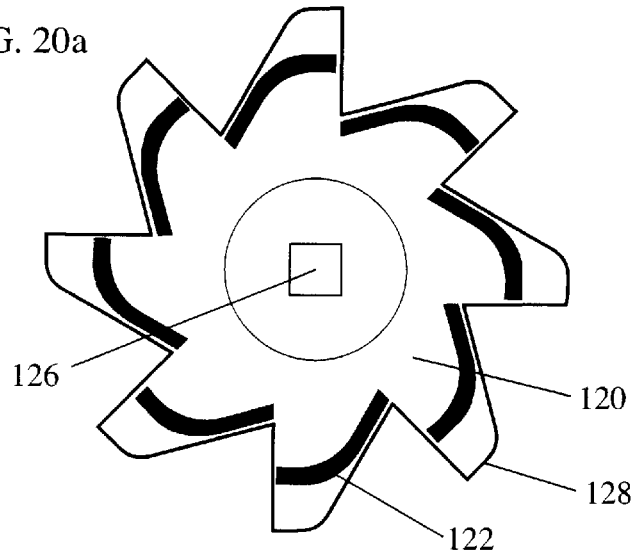
FIG. 20*a* is a top view of a cam according to an embodiment of the present application.
Figure 20B:
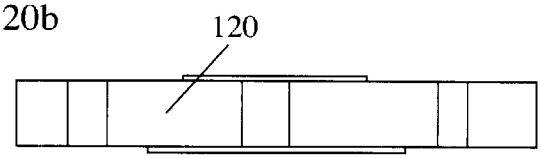
FIG. 20*b* is a side view of a cam according to an embodiment of the present application.
Figure 20C:
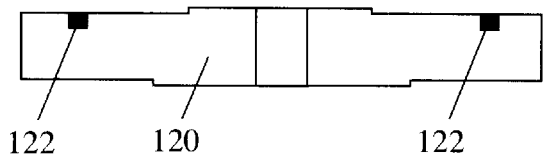
FIG. 20*c* is a side cutaway view of a cam according to an embodiment of the present application.
Figure 20D:
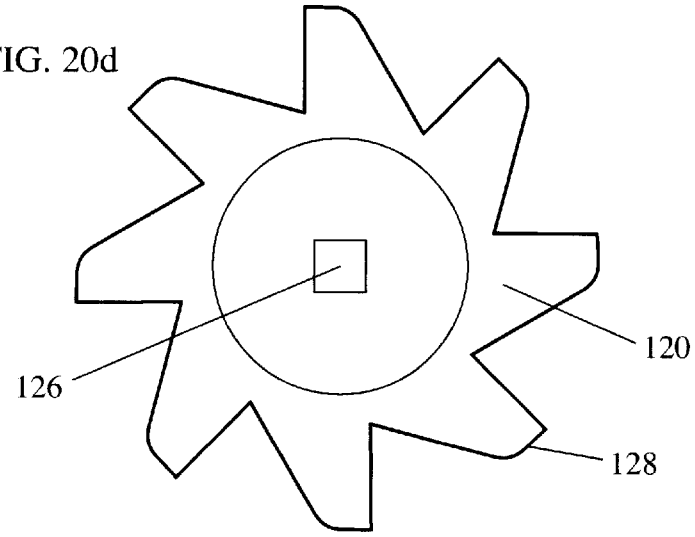
FIG. 20*d* is a bottom view of a cam according to an embodiment of the present application.

As shown in FIGS. 17*a* and 17*b*, the central locking control hub 110 comprises mounts 176. The mounts can be standard tripod mounts or other mounting receptacle or mounting shaft. Key hole 123 may also be utilized as a mount. As can be appreciated, the key receptacle of the embodiment is not utilizing detent balls, but is fit to size.

As shown in FIG. 14*b*, the reconfigurable reflective apparatus 102 comprises eight (8) support ribs 106, 108. The support ribs comprising four (4) long corner support ribs 106 displaced at 45, 135, 225 and 315 degrees and four (4) short side support ribs 108 displaced at 0, 90, 180 and 270 degrees. The support ribs 106, 108 are constructed of fiberglass, but may utilize aluminum or other suitable material.

As shown in FIGS. 18*a*–18*b* and 19*a*–19*b*, the housing comprises two housing halves 112, 114 to create a housing with openings 129*a* and 129*b* for a cam 120 and eight (8) cylinders 116.

As shown in FIGS. 20*a*–20*d*, cam 120 has groove 122 and cam edges 128 with key receptacle 126.

As shown, the groove 122 continues along the perimeter of cam 120 for receiving each engaging pin 134 of the corresponding locking piston 130 such that the rotation of the cam 120 and cam edge 128 will move the locking piston engaging pin 134 along the cam groove 122 thereby moving the locking piston 130 along the cylinder 116 formed in the housing of the central locking control hub 110.

FIGS. 21*a*–21*f* show a locking piston 130 according to an embodiment of the present application. Boss 138 reduces the contact friction area and concentrates applied force on a smaller area, while clearance cutout 137 allows the edge 128 of the cam 120 to pass.

FIGS. 22*a*–22*e* show a pivot mount 140. As shown, each locking piston 130 engages a corresponding pivot mount 140 that is rotatably connected to the housing of the central locking control hub by a pin 150 mounted in a channel in the housing of the central locking control hub 110. The pivot mount comprises an inner end 142 that is somewhat cylindrical from a side view with teeth 148 and an outer end shaft 144 that attaches to the corresponding support rib. The pin 150 is situated in a cylindrical opening 146 in the center of the pivot mount 140 that allows the pivot mount 140 to pivot about the pin 150 in a vertical plane from the central locking control hub 110. Each pivot mount 140 can independently pivot vertically at different angles from the central locking control hub 110. Each pivot mount 140 is rotatably connected to the housing of the central locking control hub 110 toward the outer end of a cylinder 116 formed in the housing of the central locking control hub 110. The inside cylindrical end 142 of the pivot mount comprises a plurality of teeth of a gear 148. The portion of the locking piston 130 situated away from the cam is then configured with a partial inside cylinder with a tooth 132 to engage the teeth of the pivot mount. Pins or other mating surface could be used instead of teeth.

Figure 23:
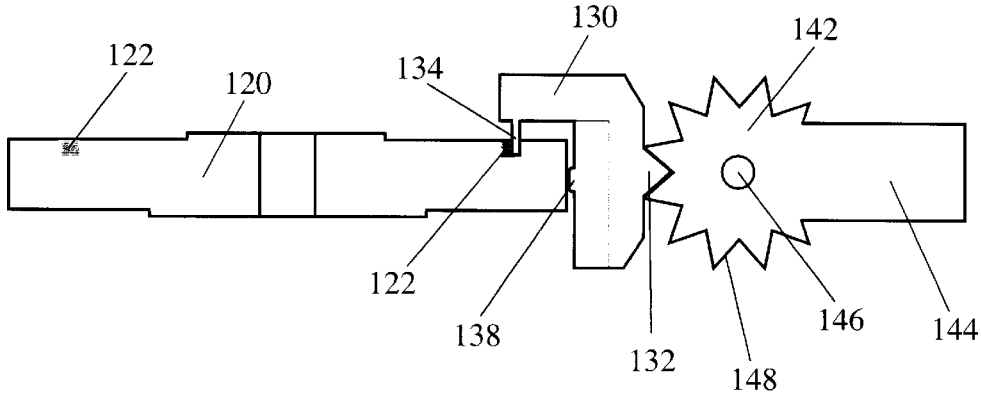
FIG. 23 is a cutaway side view of a cam connected to a locking piston engaged to a pivot mount according to an embodiment of the present application.

FIG. 23 shows a cutaway side view of a cam 120 connected to a locking piston 130 engaged to a pivot mount 140. The cam action is shown in the locked position with reference to FIG. 24*a* below.

Figure 24A:
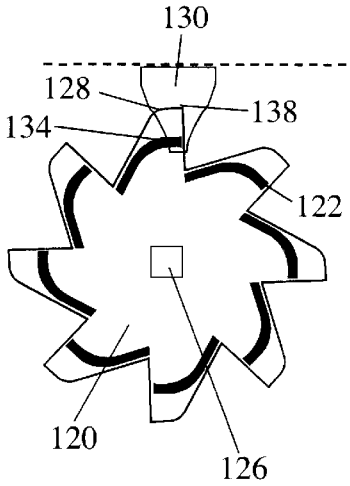
FIGS. 24*a*–24*c* are top views of the locking piston engaged in a cam from a locked position in FIG. 24*a* to an unlocked position in FIG. 24*c;*
Figure 24B:
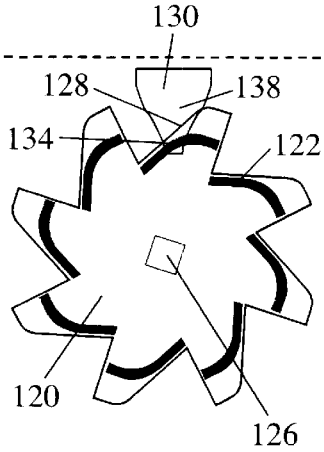
Figure 24C:
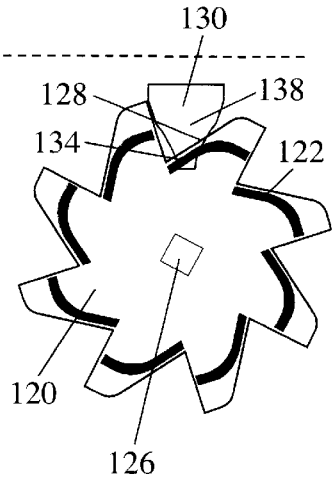

As shown in FIGS. 24*a*–24*c*, the top view of the locking piston 130 engaged in a cam 120 from a locked position in FIG. 24*a* to an open position in FIG. 24*c*. As can be appreciated, as a key is turned in key receptacle 126, the cam 120 turns and engaging pin 134 cams the locking piston which locks as shown in FIG. 23.

Figure 25A:
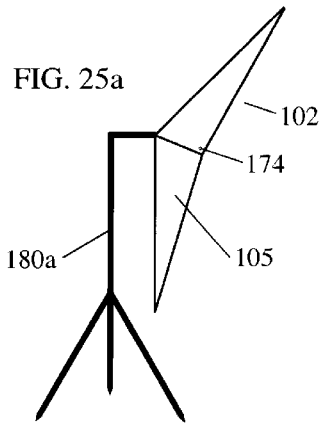
FIG. 25*a* is a side view of a reconfigurable reflective apparatus with stand with extension arm in one fixed position according to an embodiment of the present application.
Figure 25B:
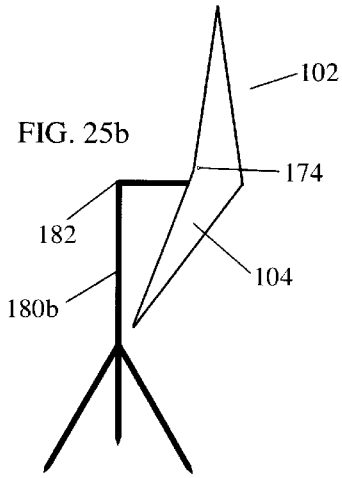
FIG. 25*b* is a side view of a reconfigurable reflective apparatus with stand with extension arm in one fixed position according to an embodiment of the present application.
Figure 25C:
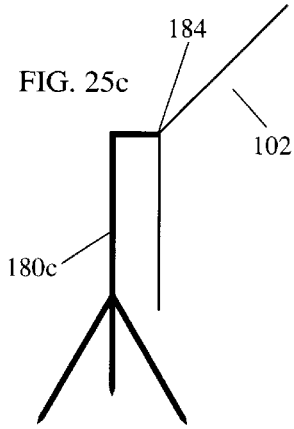
FIG. 25*c* is a side view of a reconfigurable reflective apparatus with stand with extension arm in one fixed position according to an embodiment of the present application.
Figure 25D:
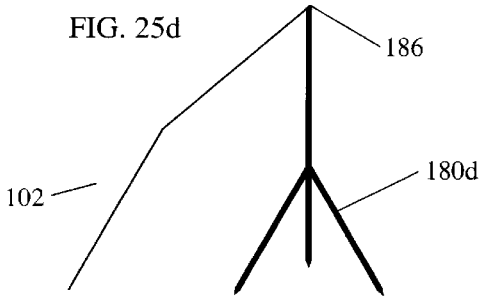
FIG. 25*d* is a side view of a reconfigurable reflective apparatus with stand in one fixed position according to an embodiment of the present application.
Figure 25E:
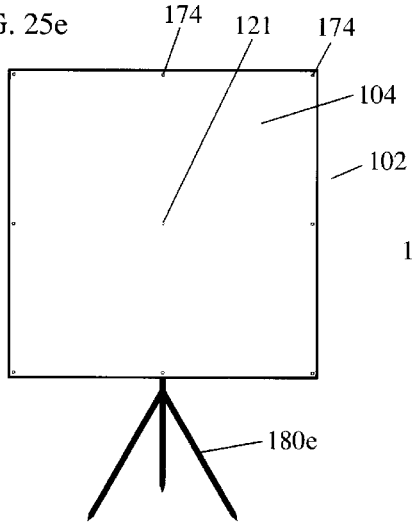
FIG. 25*e* is a front view of a reconfigurable reflective apparatus with stand connected to a mounting receptacle in one fixed position according to an embodiment of the present application.
Figure 25F:
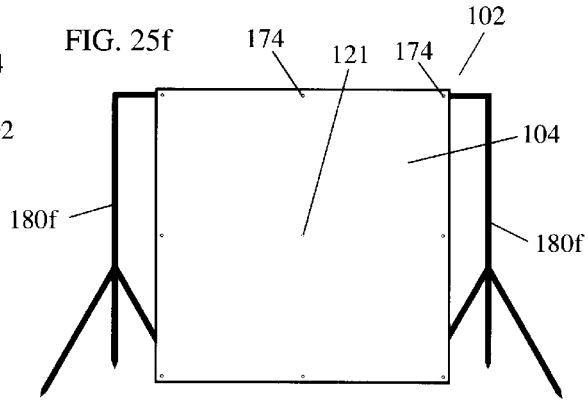
FIG. 25*f* is a front view of a reconfigurable reflective apparatus with two stands with extension arms connected to mounting grommets in one fixed position according to an embodiment of the present application.

As shown in FIGS. 25*a*–25*f*, the reconfigurable reflective apparatus 102 has reflector 104 and can be reconfigured into a variety of shapes and can be mounted in various configurations. For example, in FIG. 25*a*, a stand 180*a* is attached to a reconfigurable reflective apparatus 102 in a concave configuration. In FIG. 25*b*, stand 180*b* is a tripod with a hinged extension 182 and is mounted to a reconfigurable reflective apparatus 102 in a convex configuration. FIG. 25*c* depicts a side view showing mount 184. FIG. 25*d* shows a stand mounted to a grommet using a grommet mount 174. FIG. 25*e* shows a front key hole 121. In FIG. 25*f*, grommets 174 are used to connect to stands 180*f*.

As can be appreciated, the mounting receptacles 176 are preferably a standard tripod or stand mount such as ¼ inch standard thread mount. As can be appreciated, other fasteners such as a snap, hook, Velcro, magnetic, screw, twist lock or latch could be utilized in alternative embodiments.

Figure 26A:
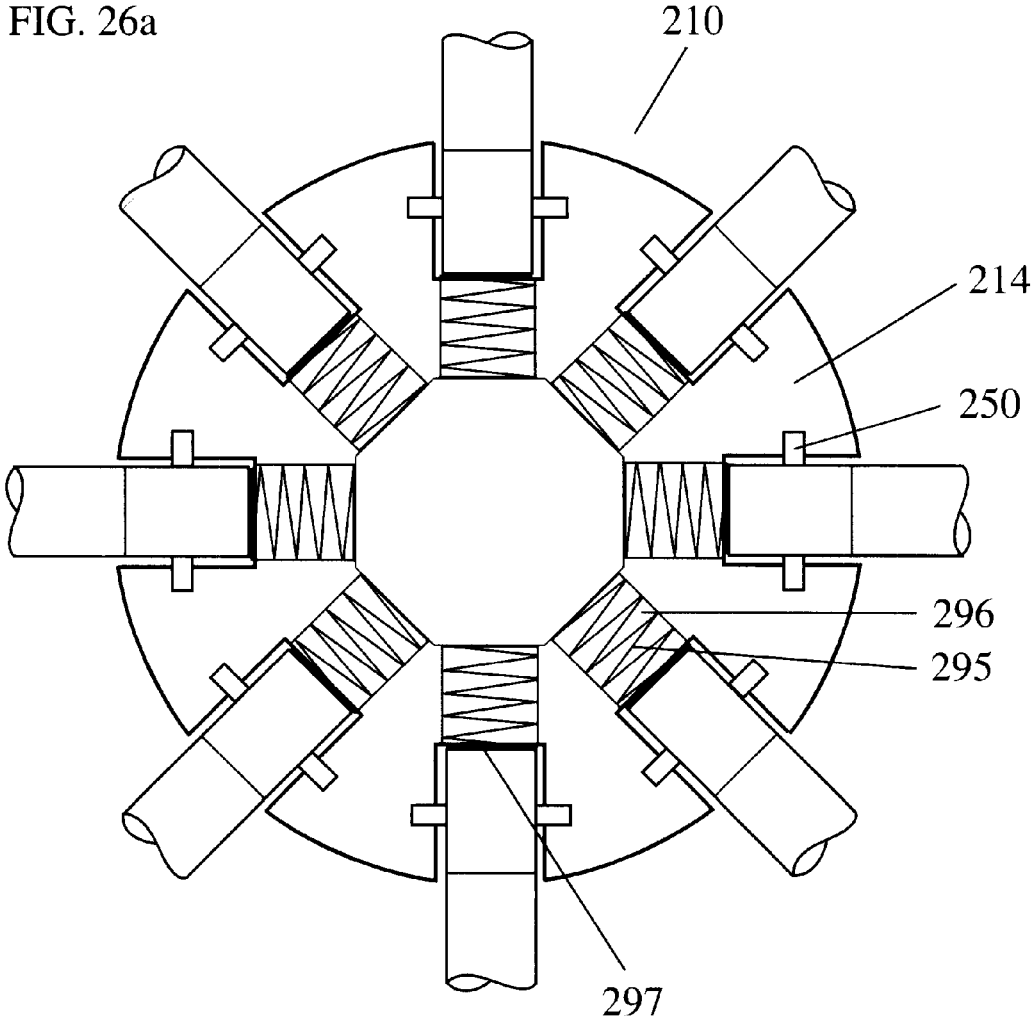
FIG. 26*a* is a top view with cut away of a central hub in a set position according to an embodiment of the present application.
Figure 26B:
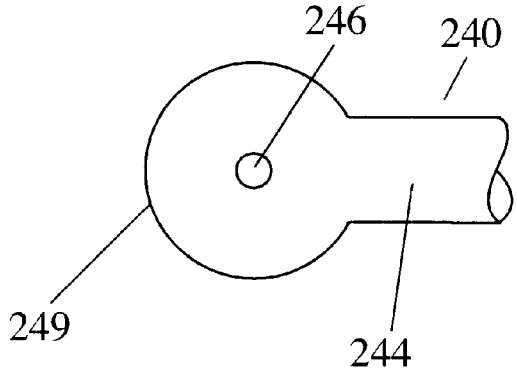
FIG. 26*b* is a side view of a pivot mount according to the embodiment of the present application shown in FIG. 26*a;*

Another embodiment having a central hub is shown with reference to FIGS. 26*a*–26*b*. A central hub 210 has a housing half 214 with spring cylinders 296 having springs 295 attached to a rubber striker 297. Pivot mounts 240 are mounted in the housing half 214 by pins 250 through pivot pin openings 246. The pivot mount 240 preferably has a body 244 and a striker mate 249 that is preferable rubber. As can be appreciated, many materials may be utilized and the striker mate may be a surface of the same part of the body 244 that may be processed to add serrations or other processing. As can be appreciated, the spring and friction surfaces are set to require somewhat more force to move the pivot mounts 240 than the force exerted by gravity when the reconfigurable apparatus is fully assembled.

Figure 27A:
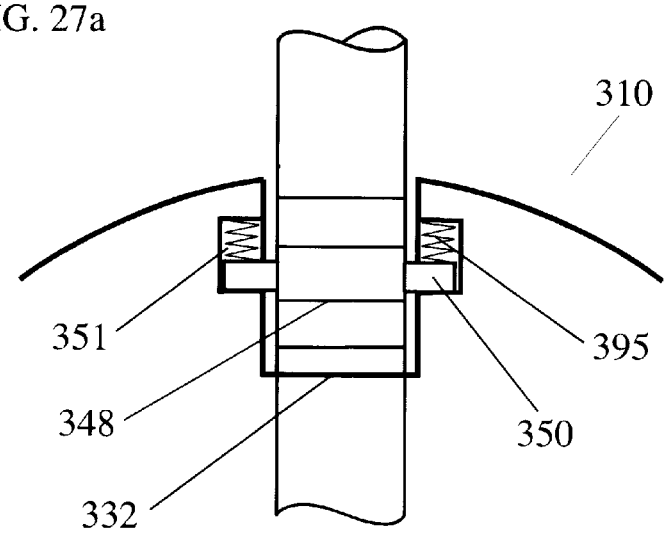
FIG. 27*a* is a partial top view with cut away of a central hub in a locked position according to an embodiment of the present application.
Figure 27B:
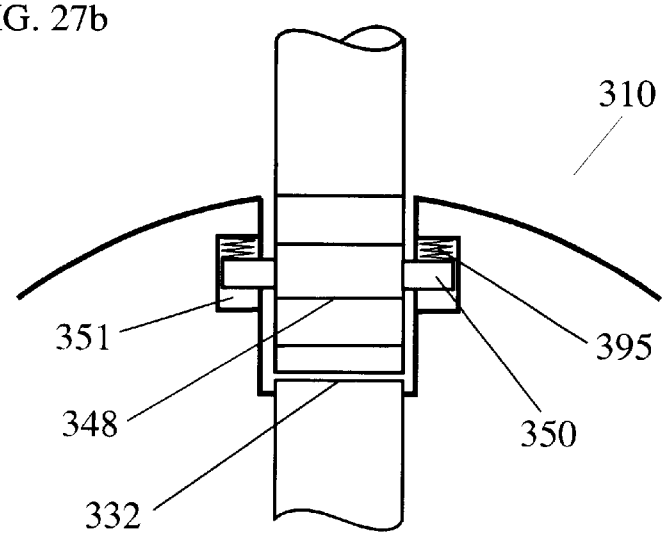
FIG. 27*b* is a partial top view with cut away of a central hub in an unlocked position according to an embodiment of the present application.
Figure 27C:
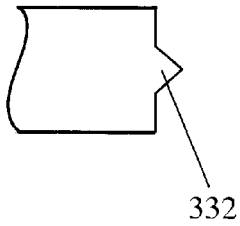
FIG. 27*c* is a partial side view with cut away of a locking tooth according to an embodiment of the present application.
Figure 27D:
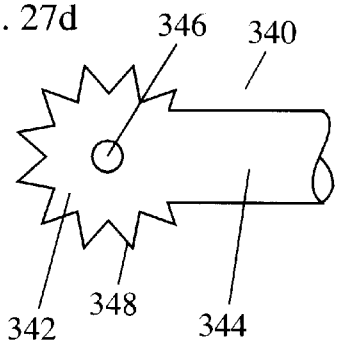
FIG. 27*d* is a partial side view with cut away of a pivot mount according to an embodiment of the present application.

Another embodiment having a central hub is shown with reference to FIGS. 27*a*–27*b*. A central hub 310 has a housing with attached locking tooth 332 at an inside end of a pivot cylinder. A pivot mount 340 is attached using a pivot mount pin 350 that is secured in pivot mount pin channels 351 that have bias springs 395 to exert force on the pivot mount pins 350 to the inside center of the housing. The pivot mount has teeth 348. As can be appreciated, the support rib may be pulled against the spring force of 395 to unlock the pivot mount such that it could be pivoted around pin 350 such that releasing the support rib or whatever is attached to the pivot mount will cause the spring bias of springs 395 to return the pivot mount to a locked position.

As can be appreciated, in alternative embodiments the support ribs may be set in the control hub at independent pivots angles by a spring loaded friction set mechanism such that a reset force can be applied to the support rib to move the support rib in order to reset the position. As can be appreciated the central hub can alternatively independently lock each support rib and an additional lock or locking pin may be utilized to lock all support ribs.

As can be appreciated, in alternative embodiments the support ribs may be telescoping. Alternatively, the ribs may be configured in sections that are fastened by shock cords. Additionally, the ribs can be hinged. As can be appreciated, the support ribs may be constructed of aluminum or other rigid materials.

It will of course be realized that while the above has been given by way of illustrative example of this invention, all such and other modifications and variations thereto as would be apparent to persons skilled in the art are deemed to fall within the broad scope and ambit of this invention as defined in the appended claims.

What is claimed is:

1. A reconfigurable reflective apparatus comprising:

a central hub;

a plurality of support ribs pivotally connected to the central hub, and a reflector supported by at least one support rib, wherein at least one of the support ribs can be independently set into any one of a plurality of pivot positions, wherein:

the central hub further comprises a housing including a plurality of cylinder openings and a plurality of locking pistons situated in the corresponding cylinder opening.

2. The reconfigurable reflective apparatus of claim 1 wherein:

the central hub further comprises a cam including a plurality of lobes, a groove and a key receptacle.

3. The reconfigurable reflective apparatus of claim 1 wherein:

the central hub further comprises a plurality of pivot pin channels in the housing and a plurality of pivot pins situated in the corresponding pivot pin channel.

4. The reconfigurable reflective apparatus of claim 3 wherein:

the central hub further comprises a plurality of pivot mounts having cylindrical openings for connecting the pivot mounts to the corresponding pivot pin.

5. The reconfigurable reflective apparatus of claim 1 wherein:

the housing further comprises an upper housing half and lower housing half connected to form the housing.

6. The reconfigurable reflective apparatus of claim 1 wherein:

the central hub includes a key receptacle, further comprising:

a key having a handle.

7. The reconfigurable reflective apparatus of claim 1 wherein:

the reflector comprises at least one mounting receptacle.

8. The reconfigurable reflective apparatus of claim 1 wherein:

the reflector comprises grommets.

9. The reconfigurable reflective apparatus of claim 1 wherein:

the plurality of support ribs consists of eight (8) support ribs including four (4) long corner support ribs and four (4) short side support ribs.

10. The reconfigurable reflective apparatus of claim 1 wherein:

the reflector comprises at least one pocket for receiving at least one support rib.

11. The reconfigurable reflective apparatus of claim 1 wherein:

the reflector comprises a material that is at least partially reflective.

12. The reconfigurable reflective apparatus of claim 11 wherein:

the reflective material reflects at least one portion of the visible spectrum of light.

13. The reconfigurable reflective apparatus of claim 11 wherein:

the reflective material comprises a fabric coated with a reflective coating.

14. The reconfigurable reflective apparatus of claim 1 wherein:

the reflector is removably connected to at least one support rib for enabling removal of the reflector from the reconfigurable reflective apparatus.

15. The reconfigurable reflective apparatus of claim 1 wherein:

the plurality of support ribs comprises a first group of support ribs having a first length and a second group of support ribs having a longer second length.

16. A central locking hub comprising:

a hub housing;

a plurality of pivot mounts pivotably connected to the hub housing, each pivot mount having a distal end for operatively connecting to a support member;

a plurality of pistons, each piston for engaging at least one pivot mount and each piston having a dosed position for setting the at least one pivot mount into a locked configuration and an open position for setting the at least one pivot mount into an open configuration; and at least one actuator operatively connected to the pistons for moving the pistons into the open and closed positions.

17. The apparatus of claim 16 wherein:

the central hub further comprises a housing having a mounting receptacle.

18. The central locking hub of claim 16, wherein the at least one actuator comprises at least one spring and at least one friction striker for biasing the pistons into the closed positions.

19. The central locking hub of claim 16, wherein the at least one actuator is operatively connected to a cam for moving the pistons into at least the open and the closed positions.

20. A central locking hub comprising:

a hub housing;

a plurality of support mounts movably connected to the hub housing, each support mount having a distal end for operatively connecting to a support member;

at least one actuator comprising a cam operatively connected to the support mounts for securing and releasing the support mounts, wherein at least one of the support mounts can be independently set into any one of a plurality of positions.

21. The central locking hub of claim 20, wherein:

the actuator further comprises a plurality of securing members operatively connected to the cam for securing and releasing a respective support mount using the cam action.

* * * * *